US007748553B2

(12) United States Patent
Akiyama et al.

(10) Patent No.: US 7,748,553 B2
(45) Date of Patent: Jul. 6, 2010

(54) SYNTHETIC RESIN CONTAINER WITH THIN WALL

(75) Inventors: Yoshio Akiyama, Tochigi (JP); Shuichi Koshio, Matsudo (JP); Masashi Yoneyama, Matsudo (JP); Hiroaki Tokuda, Koto-Ku (JP); Shoji Tanabe, Koto-Ku (JP); Shigeru Tomiyama, Koto-Ku (JP); Shigeru Yoneyama, Koto-Ku (JP)

(73) Assignee: Yoshino Kogyosho Co., Ltd., Tochigi-shi (JP)

( * ) Notice: Subject to any disclaimer, the term of this patent is extended or adjusted under 35 U.S.C. 154(b) by 685 days.

(21) Appl. No.: 10/840,294

(22) Filed: May 7, 2004

(65) Prior Publication Data

US 2004/0251258 A1 Dec. 16, 2004

Related U.S. Application Data

(62) Division of application No. 09/674,033, filed as application No. PCT/JP00/01144 on Feb. 28, 2000, now Pat. No. 6,752,284.

(30) Foreign Application Priority Data

| | | |
|---|---|---|
| Feb. 27, 1999 | (JP) | 11/96726 |
| Feb. 27, 1999 | (JP) | 11/96729 |
| Mar. 31, 1999 | (JP) | 11/94260 |
| Jun. 29, 1999 | (JP) | 11/184174 |
| Jun. 30, 1999 | (JP) | 11/185447 |

(51) Int. Cl.
*B65D 90/02* (2006.01)

(52) U.S. Cl. ..... 215/382; 215/373

(58) Field of Classification Search ..... 215/374, 215/375, 376, 370, 382; 220/606; D9/537, D9/538; 229/400
See application file for complete search history.

(56) References Cited

U.S. PATENT DOCUMENTS

| | | | | |
|---|---|---|---|---|
| D21,826 S | | 8/1892 | Grommes | |
| D26,924 S | | 4/1897 | Cropper | |
| D91,691 S | | 3/1934 | Steuer | |
| 2,022,520 A | | 11/1935 | Philbrick | |
| D162,147 S | | 2/1951 | Fuerst | |
| D183,008 S | * | 6/1958 | Lorenzezen | D9/538 |
| D193,312 S | * | 7/1962 | Buckley | D9/538 |
| 3,091,360 A | * | 5/1963 | Edwards | 206/520 |
| D198,942 S | * | 8/1964 | Johns | D9/551 |
| D205,802 S | * | 9/1966 | Pettengill | D9/538 |

(Continued)

FOREIGN PATENT DOCUMENTS

| | | |
|---|---|---|
| JP | 47-28236 | 7/1972 |

(Continued)

*Primary Examiner*—Tri M Mai
(74) *Attorney, Agent, or Firm*—Oliff & Berridge, PLC

(57) ABSTRACT

A container has a body which comprises front end rear walls, and the side walls. Each of the front and rear walls has an elliptic cross section, and is provided with a lateral recess. Each of the side walls is a vertical plan which intersects the elliptic cross section of the front and rear walls, and is provided with a plurality of reinforcements.

The container has a bottom which comprises a peripheral wall connected to the body and a bottom wall. The peripheral wall comprises slightly inclined front and rear walls, and side walls inclined by a predetermined angle. The peripheral wall is provided with a reinforcing rib.

2 Claims, 27 Drawing Sheets

U.S. PATENT DOCUMENTS

| | | | | | |
|---|---|---|---|---|---|
| 3,392,861 | A | | 7/1968 | Dimmitt et al. | |
| 3,403,804 | A | * | 10/1968 | Colombo | 215/45 |
| 3,482,724 | A | * | 12/1969 | Heaton | 215/10 |
| 3,536,223 | A | | 10/1970 | Cologne-Bickendorf et al. | |
| D223,019 | S | * | 2/1972 | Strand | D9/545 |
| 3,838,789 | A | * | 10/1974 | Cvacho | 220/634 |
| 4,065,536 | A | * | 12/1977 | Lucas | 264/535 |
| 4,082,200 | A | * | 4/1978 | Guest et al. | 215/376 |
| 4,127,207 | A | * | 11/1978 | Hubert et al. | 215/10 |
| 4,301,933 | A | * | 11/1981 | Yoshino | 215/375 |
| 4,442,944 | A | * | 4/1984 | Yoshino et al. | 215/376 |
| 4,548,348 | A | * | 10/1985 | Clements | 220/738 |
| 4,785,948 | A | * | 11/1988 | Strassheimer | 215/373 |
| 4,850,493 | A | * | 7/1989 | Howard, Jr. | 215/375 |
| D305,505 | S | | 1/1990 | Kunesh | |
| 4,919,284 | A | * | 4/1990 | Tiedemann et al. | 215/12.1 |
| D308,630 | S | * | 6/1990 | Cochran et al. | D9/520 |
| 4,949,861 | A | | 8/1990 | Cochran | |
| 4,955,492 | A | * | 9/1990 | Behm et al. | 215/12.1 |
| D315,295 | S | * | 3/1991 | Reece et al. | D9/557 |
| 5,101,990 | A | | 4/1992 | Krishnakumar et al. | |
| 5,178,290 | A | | 1/1993 | Ota et al. | |
| D347,385 | S | | 5/1994 | Kunesh | |
| 5,307,946 | A | | 5/1994 | Molinaro | |
| 5,344,036 | A | * | 9/1994 | Stanescu et al. | 215/251 |
| D360,582 | S | | 7/1995 | McDonald et al. | |
| D378,353 | S | | 3/1997 | Emre et al. | |
| D379,592 | S | * | 6/1997 | Doskoczynski | D9/542 |
| 5,713,480 | A | | 2/1998 | Petre et al. | |
| D392,894 | S | * | 3/1998 | Steih et al. | D9/542 |
| D398,538 | S | | 9/1998 | Fuquen et al. | |
| D401,860 | S | * | 12/1998 | Mentasti Granelli | D9/538 |
| D407,318 | S | * | 3/1999 | Finlay et al. | D9/538 |
| 5,988,417 | A | * | 11/1999 | Cheng et al. | 215/383 |
| 6,044,992 | A | | 4/2000 | Ma | |

FOREIGN PATENT DOCUMENTS

| | | | |
|---|---|---|---|
| JP | 55-101712 | | 8/1982 |
| JP | 61-47338 | | 3/1986 |
| JP | 61-93093 | | 5/1986 |
| JP | 62-52033 | | 3/1987 |
| JP | 62-76112 | | 5/1987 |
| JP | 5-254532 | | 10/1993 |
| JP | 7-257535 | | 10/1995 |
| JP | 9-510168 | | 10/1997 |
| JP | 10-1126 | * | 1/1998 |
| JP | 10-139029 | * | 5/1998 |

* cited by examiner (a)

(b)

(a)

(b)

(a)

(b)

SYNTHETIC RESIN CONTAINER WITH THIN WALL

This is a Divisional of application Ser. No. 09/674,033 filed Oct. 25, 2000, which in turn is a U.S. National Stage of International Application PCT/JP00/01144 filed Feb. 28, 2000. The entire disclosure of the prior applications is hereby incorporated by reference herein in its entirety.

BACKGROUND OF THE INVENTION

1. Field of the Invention

This invention relates to a synthetic resin thin wall container and, more particularly, it relates to a synthetic resin thin wall container that is reinforced but easily crushable and has an improved profile at the neck, body and bottom.

2. Related Background Art

In recent years, it has been encouraged to save plastic materials for molded products and recycle plastic products from the viewpoint of environmental protection. Efforts have been paid to provide thin wall containers so that waste containers may be crushed and collected. Thin wall containers that can be easily crushed by hand are already well known.

However, a known thin wall container weighs 0.065 g/ml for every 1 ml of the liquid contained therein if the container is made of polypropylene (PP). In other words, resin has to be used by 32.5 g to form a container with a capacity for containing 500 ml of liquid. If the container is made to weigh less than 0.05 g/ml for every 1 ml of the liquid contained therein by reducing the wall thickness, it is highly difficult for the container to maintain its shape.

Additionally, there arises a problem that, if the wall thickness of the body portion of the container is reduced, the body loses, if partly, its rigidity and buckling strength. If the wall thickness of the peripheral wall of the container bottom extending from the body portion is also reduced, the bottom can easily become deformed and/or give rise to cracks when the container is dropped and subjected to impact. The buckling strength of the bottom of the container is also reduced as a function of the reduction of the bottom wall thickness.

Then, the net result will be that, when the container is filled with liquid, the container body portion becomes deformed and/or the peripheral wall of the container bottom is buckled so that the container will no longer be able to stand upright.

Furthermore, if the body portion of a blow molded container has an elliptic cross section, adjacent containers that are being transferred from a work station to another can contact each other along a line at the sides of its major axis. Then, containers can become deformed as a result of collision.

Still additionally, as a result of line contact, containers can become displaced relative to each other and stand obliquely relative to the moving direction to consequently give rise to various problems.

Various problems also arise when blow molded containers are moved from a work station to another if the wall thickness of the shoulder portion is reduced unless the neck portion is improved and/or reinforced. Such improvement and/or reinforcement is also necessary in order to reliably close the neck with a cap after filling the container with liquid.

There also arises a problem that the container cannot be grasped by hand with the neck ring thereof in use. Finally, it is highly difficult to close the container with the cap while holding it with hand because the shoulder portion has a thin wall thickness.

In view of the above pointed out circumstances, it is an object of the present invention to provide a synthetic resin thin wall container that can be formed with a reduced amount of resin material and is provided with reinforcing ribs at relevant positions in the body and bottom to make it able to maintain its shape while it can be crushed by hand with ease.

Another object of the present invention is to provide a thin wall container having a reinforced neck so that the container can be reliably opened and closed by holding the cap with hand.

SUMMARY OF THE INVENTION

According to the invention, the above objects and other objects are achieved by providing a synthetic resin thin wall container having a flattend cross section, wherein a body comprises front and rear walls and side walls. In order to reinforce the body, each of the front and rear walls is provided with transversally extending reinforcing ribs and has an elliptical cross section. Each of the side walls is a vertical plane which intersects the elliptic cross section of the front and rear walls, and is provided with a plurality of reinforcement. The reinforcement is recesses arranged vertically at regular intervals.

Each or both of the front and rear walls is provided with a plurality of transversally extending recesses having an arcuate cross section, to make the wall surface corrugated.

In order to reinforce the bottom, the bottom comprises a peripheral wall connected to the body, and a bottom wall. The peripheral wall is inclined by a predetermined angle, and provided with a reinforcing rib.

The reinforcing rib of the bottom is an upper lateral rib provided between the body and the bottom, a lower lateral rib provided at a lower end of the peripheral wall, and/or vertical ribs arranged at regular intervals, or these combinations.

The lower lateral ribs and/or each of the longitudinal ribs has a substantially vertical lower wall.

In order to reinforce the neck, and in order to make opening of the cap easy, the neck has a holder ring or a neck ring with knurl, and a lower cylindrical neck section has a predetermined height so as to be held by a thumb and fingers.

In order to reduce the amount of the material, and in order to obtain a thick wall container, a container is preferably formed by blow molding, using PP resin by 0.015 to 0.05 g/ml or PE resin by 0.021 to 0.07 g/ml (weight of the resin per the volume of the liquid content).

PREFERRED EMBODIMENTS OF THE INVENTION

Now, the present invention will be described by referring to the accompanying drawings.

Figure 1:
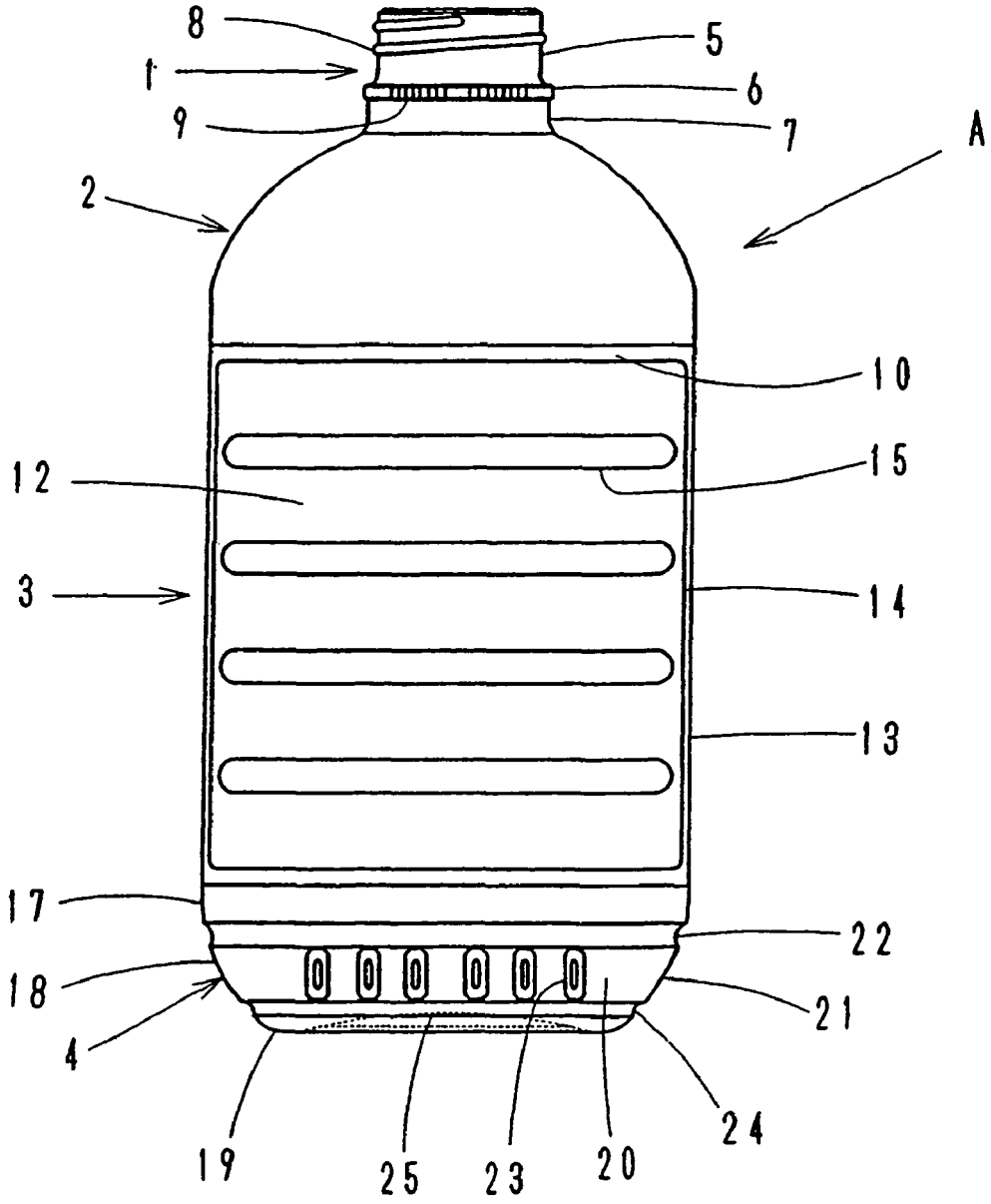
FIG. 1 is a schematic front view of a first embodiment of blow molded container according to the invention.
Figure 2:
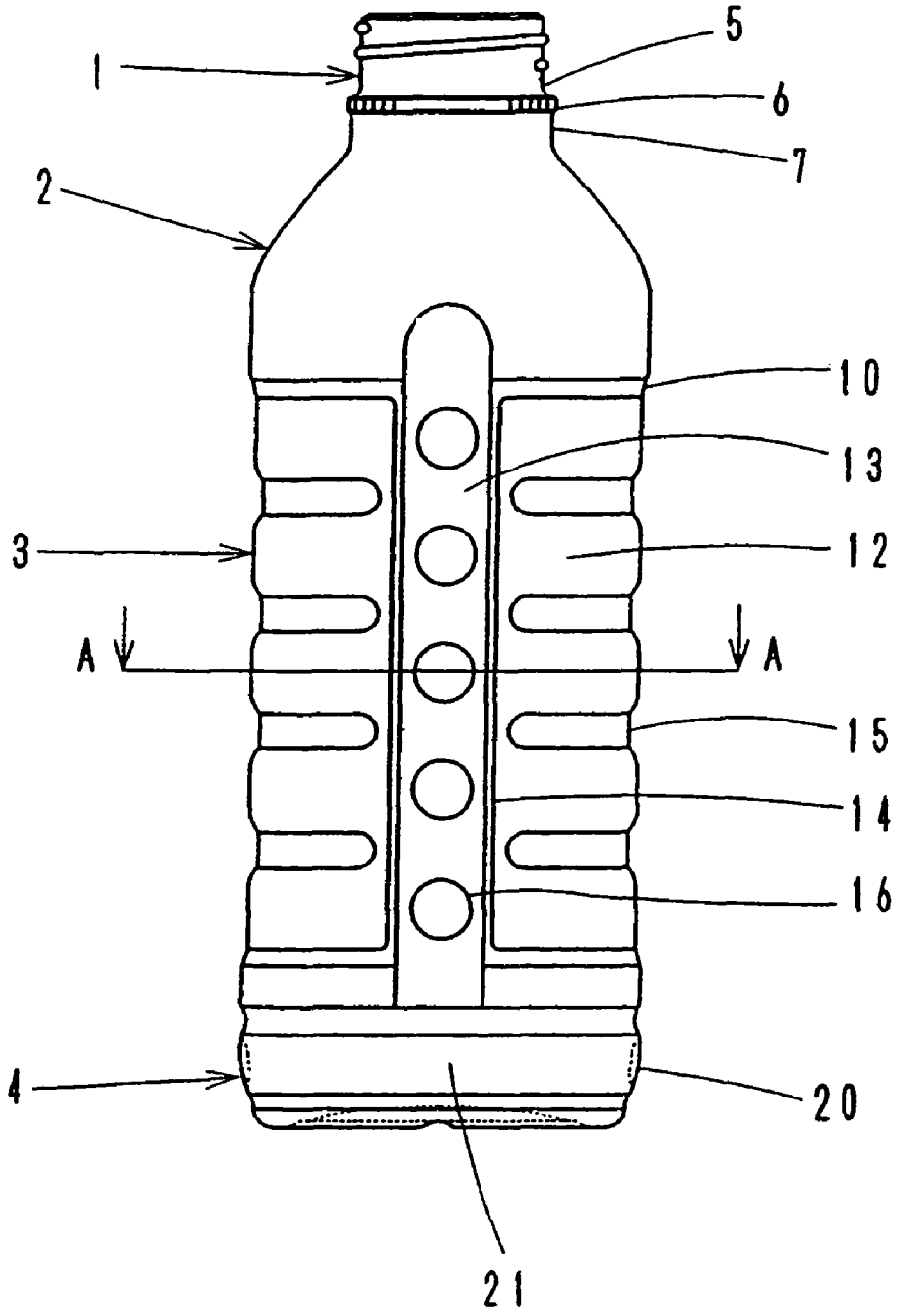
FIG. 2 is a schematic lateral view of the container of FIG. 1.

Referring to FIGS. 1 and 2, reference symbol "A" generally denotes a thin wall blow-molded container having a flattened cross sectional shape. The container is formed by direct blowing or draw-blowing, and comprises a neck 1, a shoulder 2, a body 3 and a bottom 4. The container is made of synthetic resin such as polyethylene (PE), polypropylene (PP), polyethyleneterephthate (PET) or some other synthetic resin, and formed as monolayer or multilayer container by blow molding.

The neck 1 comprises an upper cylindrical neck section 5, a holder ring 6 located at a middle of the neck, and a lower cylindrical neck section 7 extending downwardly from the holder ring 6 and connected to the shoulder 2.

The upper cylindrical neck section 5 is formed on an outer peripheral surface thereof with a thread 8. The holder ring 6 is radially protruded from the upper cylindrical neck section 5 and the lower cylindrical neck section 7, and is partly or entirely formed with knurls 9.

The lower cylindrical neck section 7 has a predetermined height so that it may be held by a thumb and fingers. It has a diameter smaller than that of the holder ring and greater than that of the upper cylindrical neck section 5, and is connected to the shoulder 2.

Figure 3:
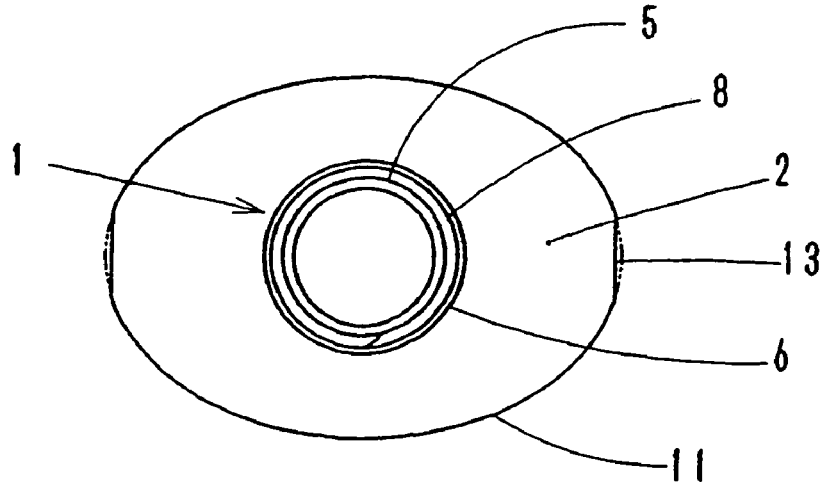
FIG. 3 is a schematic plan view of the container of FIG. 1.
Figure 4:
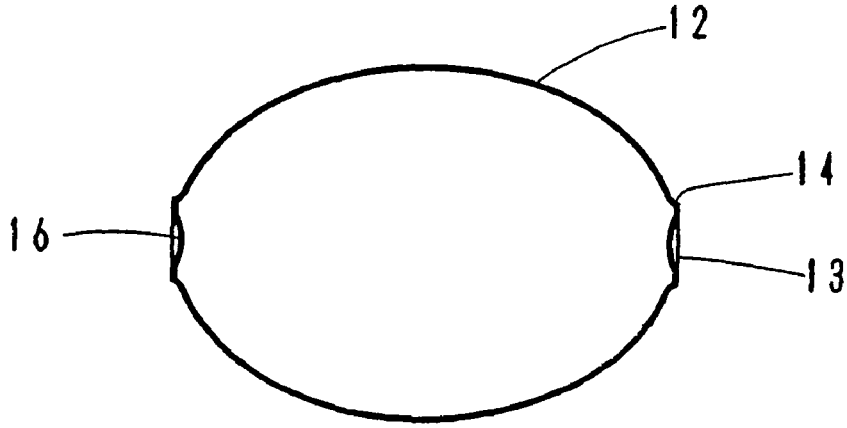
FIG. 4 is a schematic transversal cross sectional view of the body of the container of FIG. 1 taken along line A-A in FIG. 2.

A step 10 is formed between the shoulder 2 and the body 3. As illustrated in FIGS. 3 and 4, each of the shoulder 2 and the body 3 has a flattened cross section 11, which comprises elliptical front and rear surfaces and a planar side surfaces.

The body 3 comprises front and rear walls 12 and side walls 13. Each of the side walls 13 has a vertical plane which intersects the elliptic cross section of the front and rear walls 12. An upper end of each of the side walls extends to the shoulder 2. Lateral edges of the side walls are connected to lateral edges of the front and rear walls 12 via a narrow wall 14 having an arcuate cross sectional shape.

Each of the front and rear walls 12 of the body 3 is provided with transversal grooves 15 that are arranged vertically at regular intervals. Since the grooves 15 are formed, each of the front and rear walls 15 has vertically corrugate or waved surface.

Each of the side walls 13 connects with the arcuate walls 14 with a predetermined angle. Each of the side walls 13 is provided on the surfaces thereof with a plurality of circular reinforcement recesses 16 that are arranged vertically at regular intervals.

The body 3 is provided at a lower end thereof with a protruded peripheral wall 17 that forms a step and continues to the bottom 4.

As illustrated in FIGS. 1, 2, 5 and 6, the bottom 4 comprises a peripheral wall 18 and a bottom wall 19. The peripheral wall 18 has slightly tilted front and rear walls 20, and right and left side walls 21 that are inclined by a predetermined angle.

Figure 5:
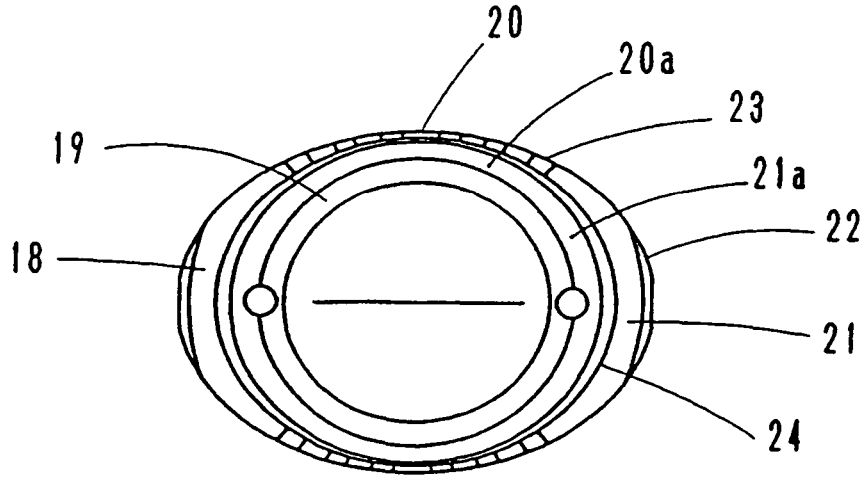
FIG. 5 is a schematic bottom view of the container of FIG. 1.
Figure 6:
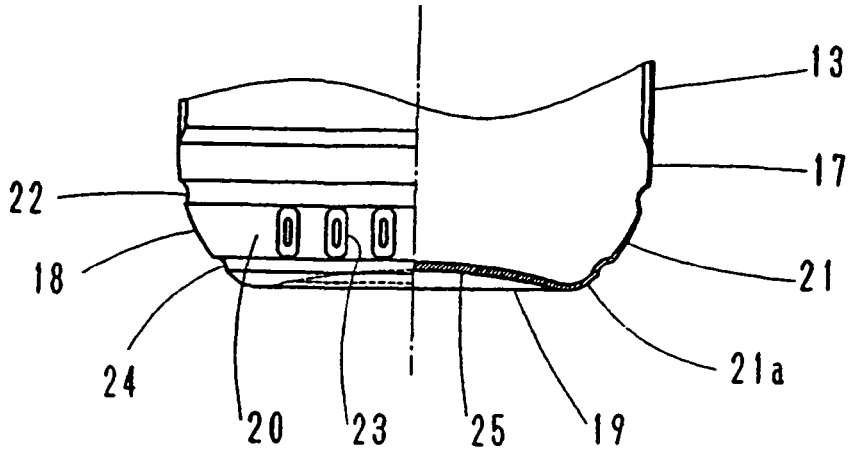
FIG. 6 is a schematic partly cross sectional front view of the bottom of the container of FIG. 1.

As shown in FIG. 5, a distance from a center of the container to lower ends 21*a* of the inclined side walls 21 is made close to a distance from the center of the container to lower ends 20*a* of the front and rear walls 20, so that these distances are substantially same each other.

In other words, an outer periphery of the bottom wall 19 is elliptical whose major axis and the minor axis show a minimal difference. Each of the side walls 21 is inclined, connected to each of the side walls 13 at an upper end thereof, and connected at a lower end thereof to the bottom wall 19 whose radius is smaller than a radius of a major axis of the body.

Since the radius of the lower end of the side walls 21 is smaller than the radius of the major axis of the body, when the container is blow-molded, the blow ratio is reduced in response to the difference of the angle of the inclination of the side walls, so that a thickness of the lower end 21*a* is greater than that of the side wall 13.

The angle of inclination is defined by the required wall thickness of the body and that of the periphery of the bottom wall.

An upper lateral rib 22 is circumferentially provided between the peripheral wall 18 and the protruded peripheral wall 17 of the body 3. Each of the front and rear walls 20 is provided with a plurality of longitudinal ribs 23 that are arranged at regular intervals.

The peripheral wall 18 is circumferentially provided at a lower end thereof with a lower lateral rib 24. The lower lateral rib 24 is connected to at a lower side thereof to the bottom wall 19 having an upwardly curved surface 25 at a center thereof.

Now, the method of molding the container will be discussed below. The container according to the invention is molded by means of a known direct blow technique or a known draw-blowing technique.

According to the conventional technique, if an easily crushable thin wall container of PP resin that satisfactorily maintains its shape is molded by direct-blowing PP resin, 0.067 g/ml of resin was necessary. On the other hand, according to the present invention, the consumed resin can be reduced to 0.015 to 0.05 g/ml (weight of the resin per the volume of the liquid content), because of the arrangement of the reinforcements to the body wall and the peripheral wall of the bottom. Similarly, according to the conventional technique, if an easily crushable thin wall container of PE resin that satisfactorily maintains its shape is molded by direct-blowing PE resin, 0.096 g/ml of resin was necessary. On the other hand, according to the present invention, the consumed resin can be reduced to 0.021 to 0.07 g/ml (weight of the resin per the volume of the liquid content), because of the arrangement of the reinforcements to the body wall and the peripheral wall of the bottom. If the PET resin is used, the present invention provides similar advantage or effect by biaxially blow-molding the PET and by arranging the reinforcements to the body wall and the peripheral wall of the bottom.

In case of a thin wall container, the wall thickness of the body should be less than about 0.6 mm. In order to obtain an easily crushable container, the thickness is preferably 0.3 mm or less.

According to an example of the present invention, the side wall has the thickness of 0.1-0.15 mm, and each of the front and rear walls has the thickness of 0.15-0.3 mm.

Now the advantages of a crushable thin wall container according to the invention will be discussed below.

Relating to the body 3, each of the front and rear walls 12 is reinforced by the laterally extending recesses 15. Since the side wall 13 and the arcuate walls 14 form an edge having a right angle in a cross section, the edge acts as reinforcing rib, to act as pillar of the body.

Each of the side walls 13 is formed with reinforcement recesses 16 which are vertically arranged at regular intervals, so as to improve the buckling strength of the body.

Since each of the side walls 13 has a flat surface, when containers are transferred, the containers can be placed adjacent to one another with flat surfaces in a surface-to-surface contact, so as to prevent the container from deforming, even if the containers crash one another.

Since the containers can be placed adjacent to one another with the walls 13 in a surface-to-surface contact, containers are positioned such that their major axes are aligned with a direction of the transfer, so as to keep their alignment.

Relating to the bottom 4, the peripheral wall 18 comprises slightly inclined front and rear walls 20, and side walls 21. Since each of the side walls 21 is tilted by a predetermined angle, the lower ends 21*a* of the side walls 20 are made to show a wall thickness greater than that of the side walls 13.

As a result, the peripheral walls are strongly resistant against impact when the container is dropped.

Additionally, since the peripheral wall 18 of the bottom is reinforced by the lateral ribs 22, 24 and longitudinal ribs 23, if the container is dropped, the peripheral wall would not be deformed, and would not crack. In addition, the peripheral wall shows an improved buckling strength.

Relating to the thickness of the container, when a conventional container made of PP resin and having a wall thickness of 0.6 mm or less at the body is dropped and subjected to impact, the peripheral walls of the bottom would be deformed or would crack. To the contrary, a container according to the invention having the above described configuration is perfectly prevented from being deformed and cracking.

Relating to the neck, although the neck 1 has a wall thickness greater than that of the body 2, its wall thickness is still smaller than that of any conventional container. Thus, the neck is reinforced by forming the radially protruded holder ring 6 at the middle of the neck.

Since the height from the shoulder to the holder ring is selected such that a thumb and finger can be inserted therebetween, the container can be easily held with a thumb and fingers. Since the holder ring is formed with the knurls 9, the container can be held without slipping.

Modified Embodiments

Now embodiments obtained by modifying the body, the bottom and/or the neck of the above embodiment will be described below.

1st Embodiment

Figure 7:
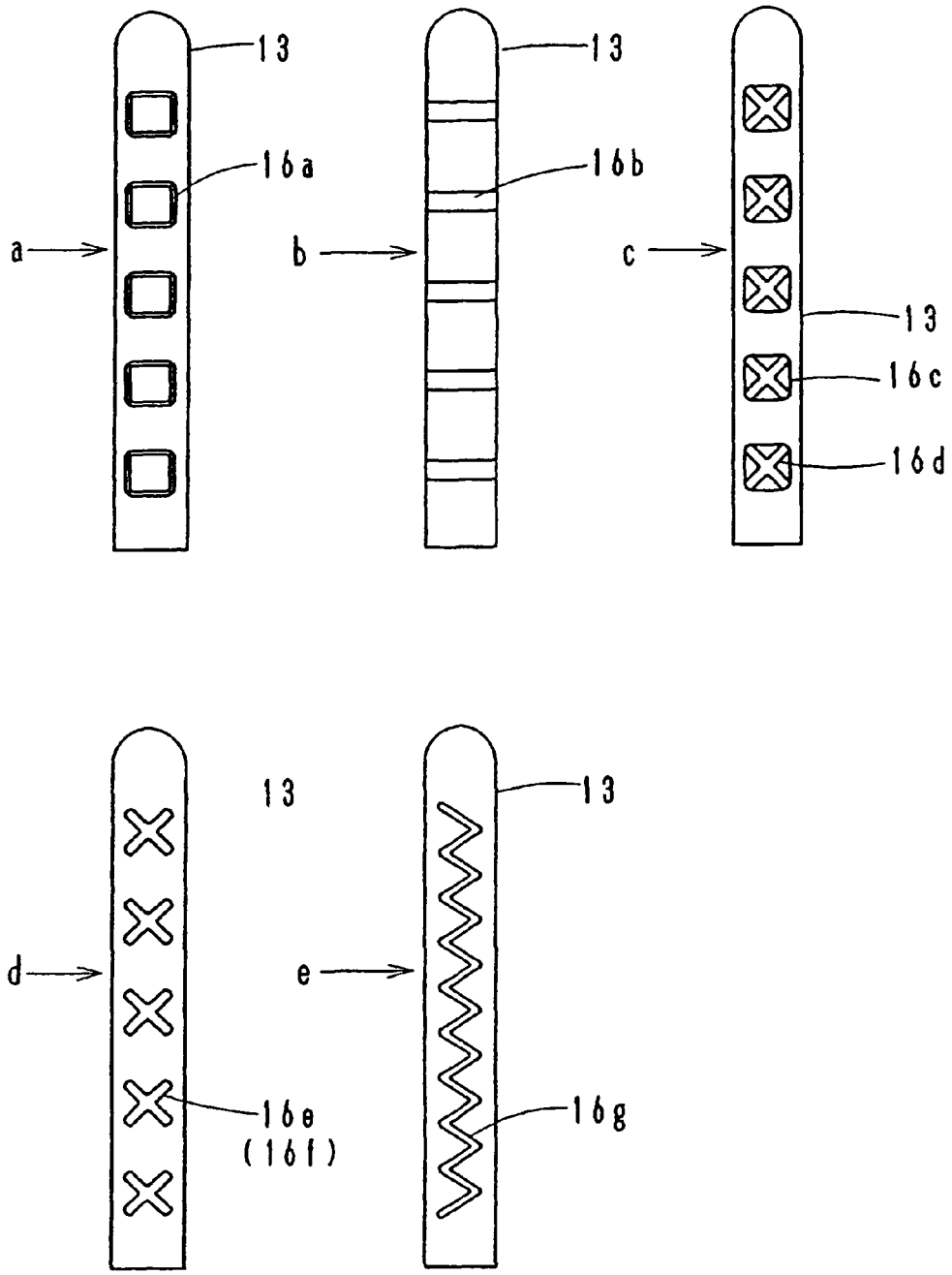
FIG. 7 is a schematic illustration of the reinforcements of the body that may be used for the first embodiment of container according to the invention.

In the first modified embodiment, the body is modified. Although each of the side walls is provided on the surface thereof with circular reinforcement recesses 16 in the above embodiment, any of the reinforcements as shown in FIG. 7 may be used for the purpose of the invention.

FIG. 7*a* shows square recesses 16*a* having flat bottom.

FIG. 7*b* shows transversally extending recessed ribs 16.

FIG. 7*c* shows square recesses 16*c* having flat bottom with additional X-shaped projecting ribs 16*d*.

FIG. 7*d* shows X-shaped recesses 16*e* or X-shaped projecting ribs 16*f*. In case of the X-shaped projected ribs 16*f*, surfaces of the ribs are contacted one another in surface-to-surface, so as to provide the advantage same as that of the above described embodiment.

In FIG. 7*e* shows a recessed rib having a zigzag profile and extending longitudinally.

Each of these reinforcements provides the advantage same as described above to the side wall.

2nd Embodiment

This second modified embodiment is obtained by modifying the side walls of the above embodiment.

More specifically, the side walls of the body of this embodiment differ from those of the above embodiment, although the neck, the shoulder and the bottom as well as the cross section of the body and the configuration of the front and rear walls are same as their counterparts of the above embodiment. Therefore, in FIGS. 8 and 9 that illustrate this modified embodiment, they are denoted respectively by the same reference numerals, each of which is accompanied by suffix a and will be described only briefly below particularly in terms of the side walls.

Figure 8:
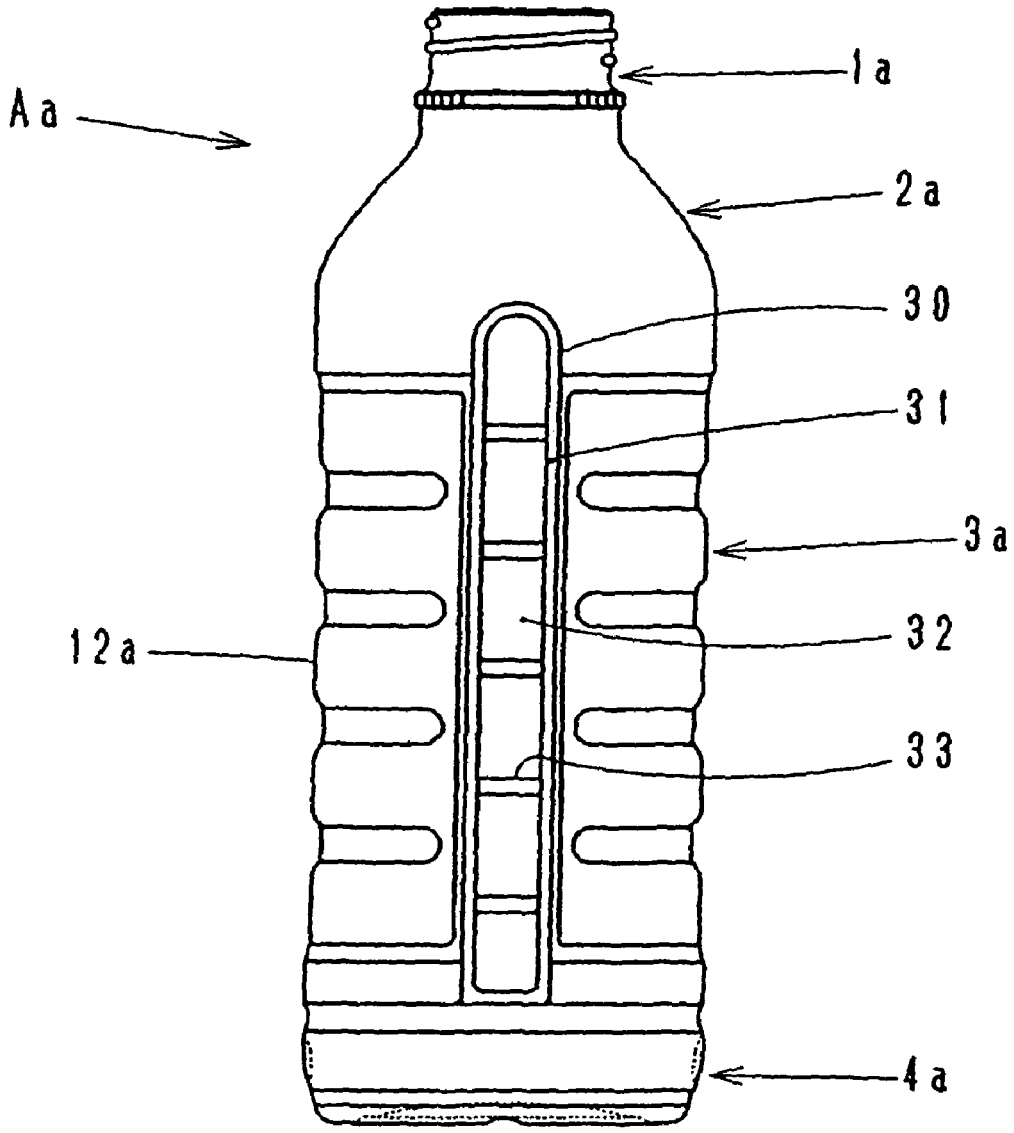
FIG. 8 is a schematic lateral view of a second embodiment of blow molded container according to the invention.

Referring to FIG. 8, the blow molded container "Aa" comprises a neck 1*a*, a shoulder 2*a*, a body 3*a* and a bottom 4*a*.

As in the case of the above embodiment, the body 3*a* includes front and rear walls 12*a* and side walls 30.

Each of the side walls 30 comprises an edge section 31 having a predetermined width and running all the way along the periphery of the surface thereof, and a flat bottom recess 32 within the edge section 31.

The flat bottom recess 32 is provided on a bottom thereof with a plurality of transversally extending projecting ribs 33 that are arranged vertically at regular intervals and connected to the edge section 31.

The edge section 31 of the side wall 30 acts as a longitudinal rib. Each of the projecting ribs 33 acts as a reinforcing rib. Thus, the side wall 30 is reinforced, so that the illustrated embodiment provides an advantage same as the above described embodiments.

Figure 9:
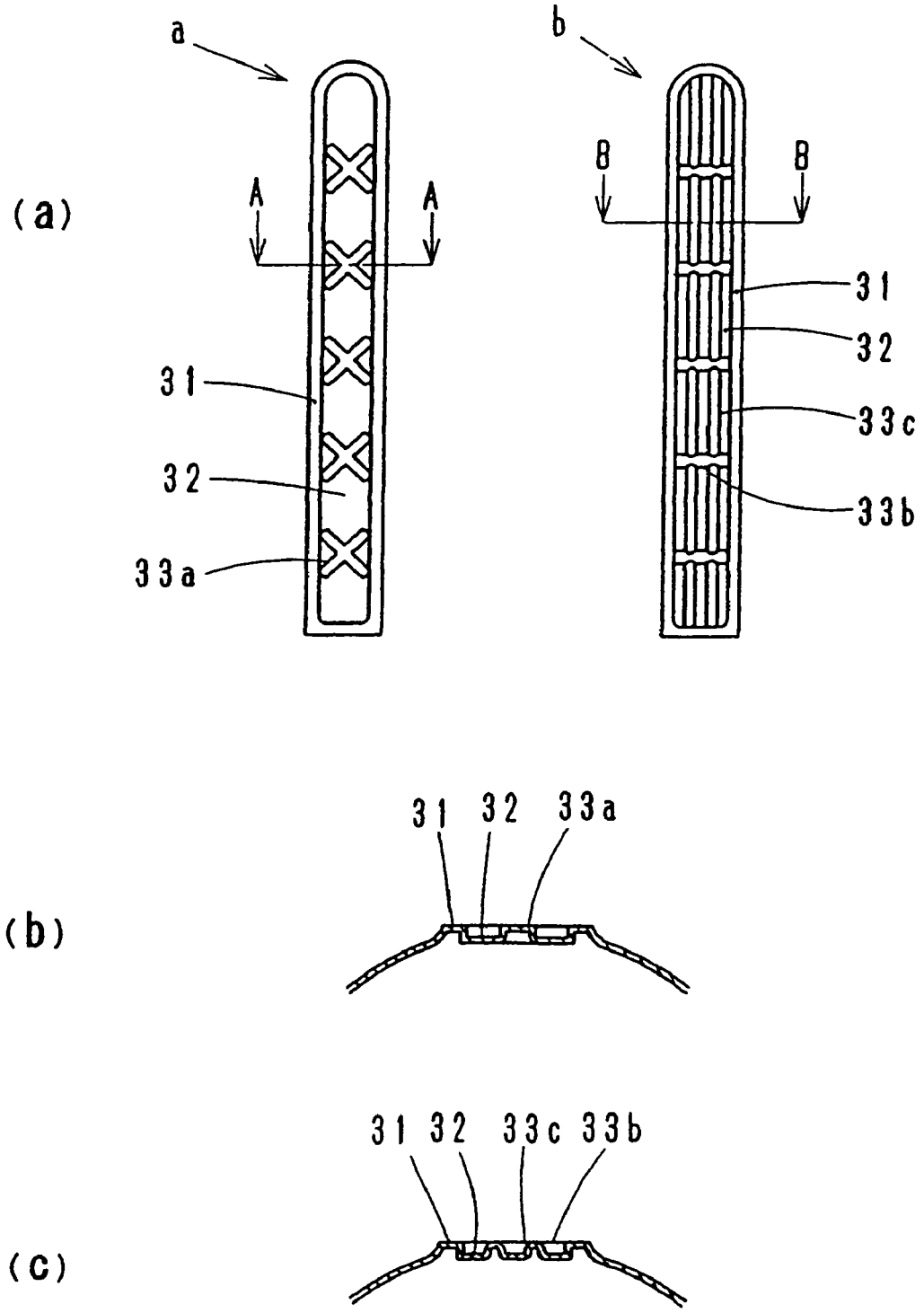
FIG. 9 is schematic illustrations of the second embodiment, of which (a) is a schematic front view of the side walls, (b) is a schematic transversal cross sectional view taken along line A-A in (a) and (c) is a schematic transversal cross sectional view taken along line B-B in (a).

The projecting reinforcing ribs 33 arranged at the flat bottom recess 32 of each of the side walls 30 of this embodiment may be replaced by any of the reinforcements illustrated in FIG. 9.

In FIG. 9*a* shows X-shaped projecting ribs 33*a*.

In FIG. 9*b* shows transversally extending projecting ribs 33*b* and one or two longitudinal projecting ribs 33*c* extending between any two adjacent transversal projecting ribs 33*b*.

These reinforcements provide an advantage same as that of the above described embodiment.

3rd Embodiment

Now, a third modified embodiment obtained by modifying the front and rear walls of the body will be discussed below.

Figure 10:
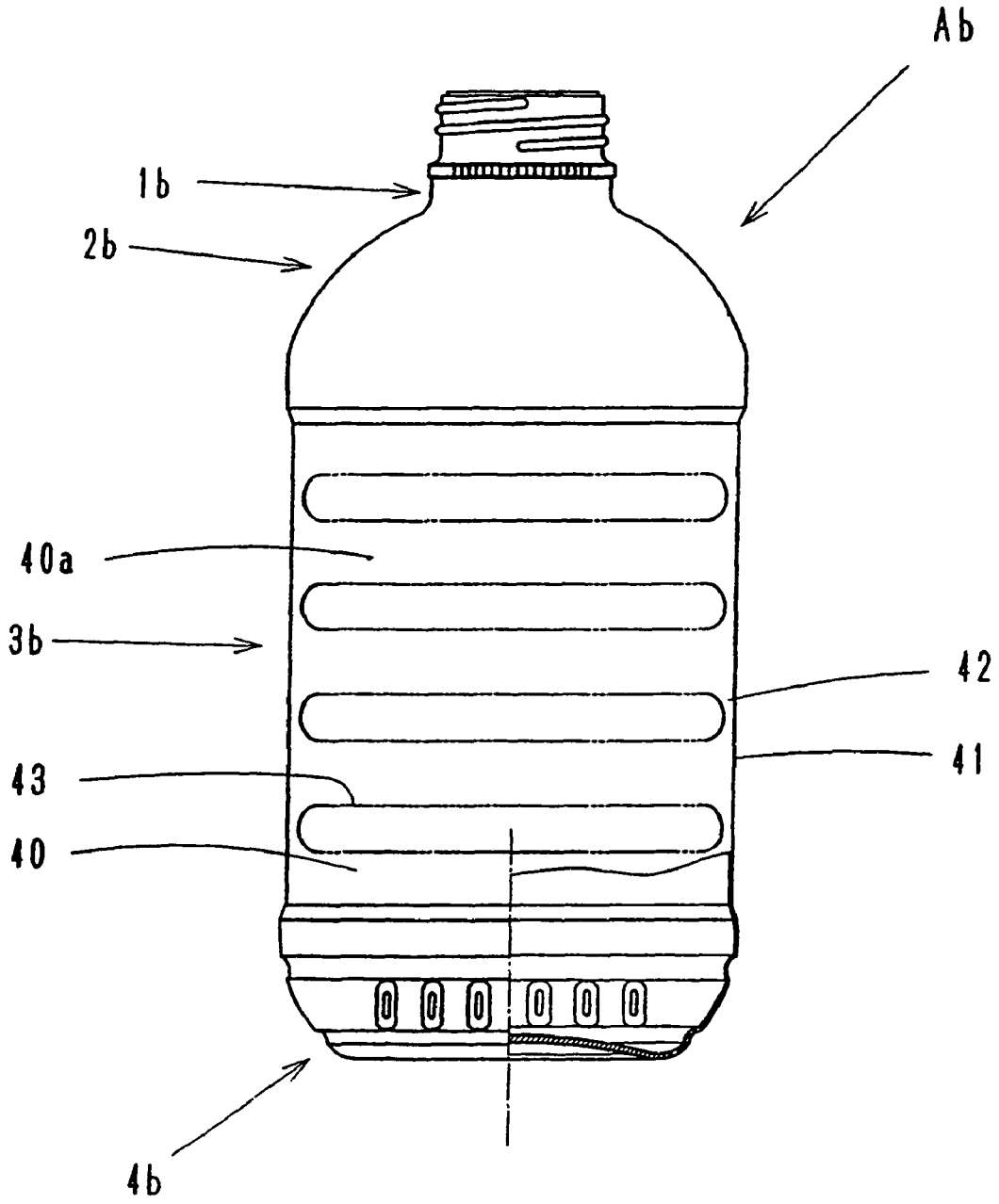
FIG. 10 is a schematic partly cross sectional front view of a third embodiment of blow molded container according to the invention.
Figure 11:
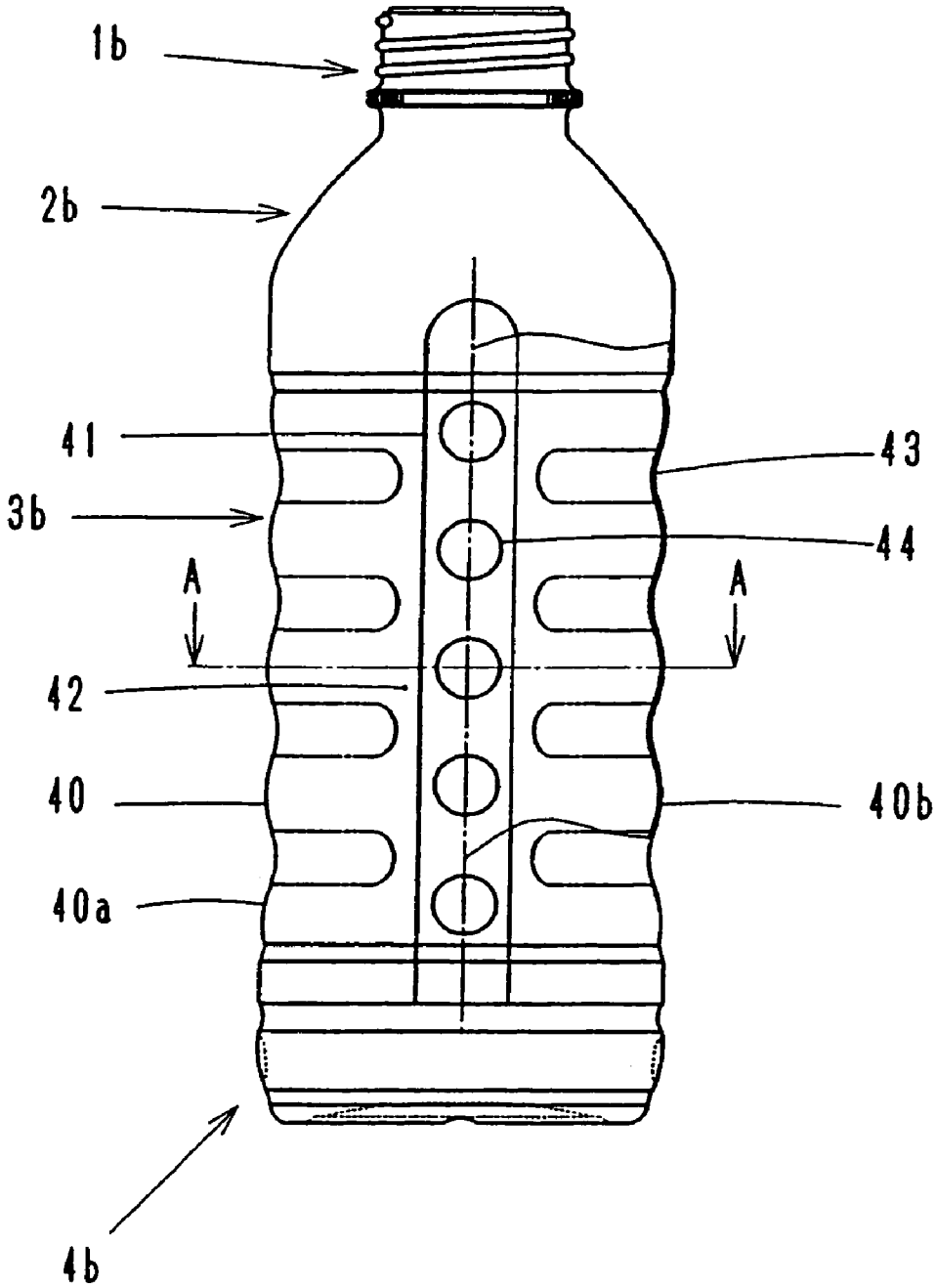
FIG. 11 is a schematic partly cross sectional lateral view of the embodiment of FIG. 10.
Figure 12:
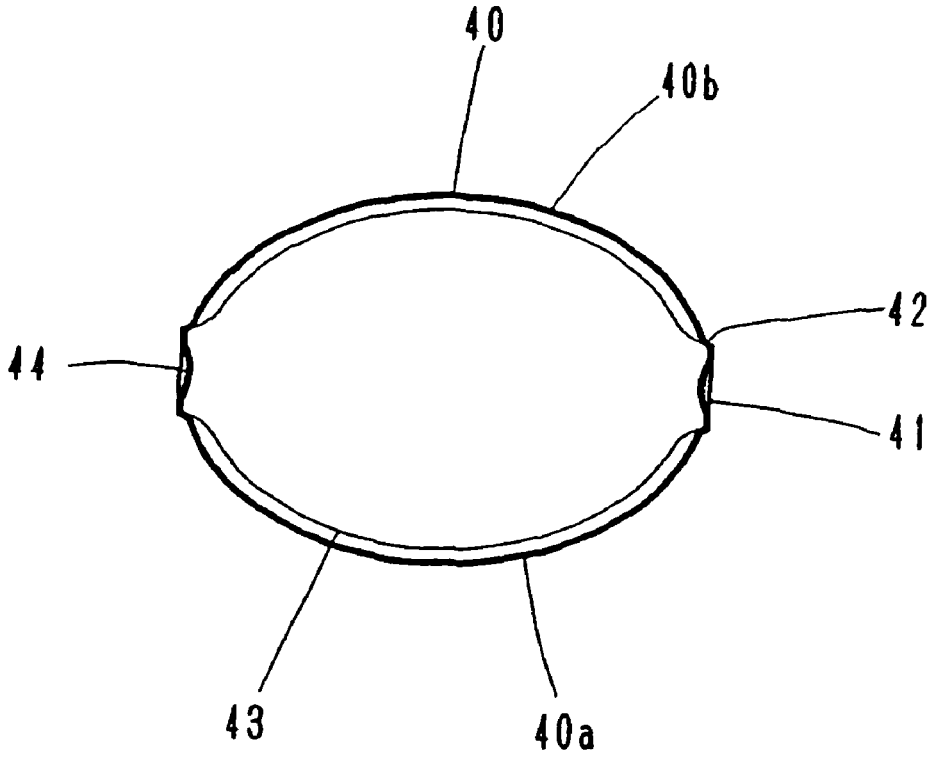
FIG. 12 is a schematic transversal cross sectional view of the body of the container of FIG. 11 taken along line A-A in FIG. 11.

Since the neck, the shoulder and the bottom as well as the cross section of the body are same as their counterparts of the above embodiment, they are denoted respectively by the same reference numerals which are accompanied by suffix b in FIGS. 10 through 12. This embodiment will be described only briefly below particularly in terms of the front an drear walls.

As illustrated in FIGS. 10 through 12, the body 3*b* comprises front and rear walls 40 including a front wall 40*a* and a rear wall 40*b*, each of which shows an elliptic cross section, and side walls 41. Each of the side walls 41 is a vertical plane, and intersects the elliptic cross section of the front and rear walls 40. An upper end of each of reaches to the shoulder 2*b*. Lateral edges of the side walls 41 and corresponding lateral edges of the front and rear walls 40 are connected through narrow arcuate walls 42.

Each of the front and rear walls 40, or the front wall 40*a* and the rear wall 40 is provided with transversal recesses 43 arranged vertically at regular intervals, each of recesses having arcuate cross-section. Each of the front and rear walls 40 has a vertically corrugated surface including successive ridges and grooves by the provision of the grooves 43.

The corrugation produced by the recesses 43 may be arranged only either on the front wall 40*a* or on the rear wall 40*b*.

The recesses 43 are even in number, so that a ridge is located at a vertical center of each of the front and rear walls.

The side walls 41 and the corresponding arcuate walls 42 show a predetermined angle. Each of the side walls 41 is provided with a plurality of circular reinforcement recesses 44 that are arranged vertically at regular intervals.

Now, the function and the advantages of the above arrangement will be discussed below.

Since both the front wall 40*a* and the rear wall 40*b* or either the front wall 40*a* or the rear wall 40*b* of the body 3*b* is provided with transversal recesses 43 that are arranged vertically at regular intervals to make the wall surface vertically corrugated, the body is improved in terms of rigidity and the strength of withstanding reduced pressure.

Since the recesses are provided even in number, a ridge is located at the vertical center of the front and/or rear wall of the body.

Of the ridges and the grooves of the corrugated surfaces of the body, the ridges are more rigid than the grooves.

Generally, a container is held by a thumb and fingers pinching a central part of the body. Thus, the ridge located at the vertical center of the front and/or rear wall of the body can effectively suppress any possible deformation that may be caused by the thumb and the fingers pinching the body.

Additionally, the body is apt to be deformed at a central portion thereof if a bending moment is applied between an upper portion and a lower portion of the body. However, the ridge located at the vertical center can also effectively suppress such deformation.

Still additionally, since each of the side walls 41 is vertical plane and define a predetermined angle with the corresponding arcuate walls 42 arranged at the edges of the front and rear walls 40, their connecting sections act like so many vertical reinforcing ribs that improves the buckling strength of the body 3*b* because they are angled sections.

Now, the effect of the corrugation of the front and/or rear wall and that of the vertical planes of the side walls was examined in experiments. This will be described below.

[Experiment 1]

Three containers with a capacity of 600 ml were formed by 17.5 g of PP (in other words, 0.0292 g/ml which means weight of the material resin per the volume of the liquid content). Each of thus obtained container has a profile same as the above described embodiment at the neck, the shoulder and the bottom, and also has a side wall of a vertical plane. For comparison, two of them had a modified front and/or rear walls.

The first container had the front and rear walls, each of which had vertically corrugate surface due to the transversal grooves, the second container had the front and rear walls, one of which had vertically corrugate surface, the third container had front and rear walls without corrugation, and the strength of the body was observed.

The rigidity of the body of the second container was improved by +84.7%, and the rigidity of the body of the first container was improved by +167%, if compared with a body without corrugation. An increase in the strength against reduced pressure was also observed.

[Experiment 2]

In this experiment, the effect of providing the side walls with vertical straight planes was observed. A container having no side wall (in other words, having an elliptic cross section) was further prepared. If compared with the container having no side wall, the container having the side walls of the vertical planes showed an improvement of +22.9% in the bucking strength, an improvement of 19.1% in the rigidity along the minor axis, an improvement of +48% in the rigidity along the major axis, and an improvement of +12.5% in the strength of withstanding reduced pressure. Thus, the provision of side walls having straight planes proved a significant improvement in terms of buckling strength, rigidity of the body and strength of withstanding reduced pressure.

[Experiment 3]

In this experiment, container specimens having a body whose front and rear walls were vertically corrugated were prepared as in Experiment 1 but the number of recesses on the front and rear walls of the body was made to vary among the specimens to see the rigidity at the center of the body. The force required to depress the center of the body to a predetermined extent increased by 169% when the number of recesses was four, by 112% when the number of recesses was five and 148% when the number of recesses was six if compared with a container having three recesses at each of the front and rear walls of the body. Thus, it was proved that the front and rear walls of a body having an even number of recesses and a ridge located at the vertical center thereof are significantly stronger than their counterparts of a body having an odd number of recesses.

This result of the experiment also applies to a blow molded container according to the invention and having side walls 13 that show vertical planes.

Figure 13:
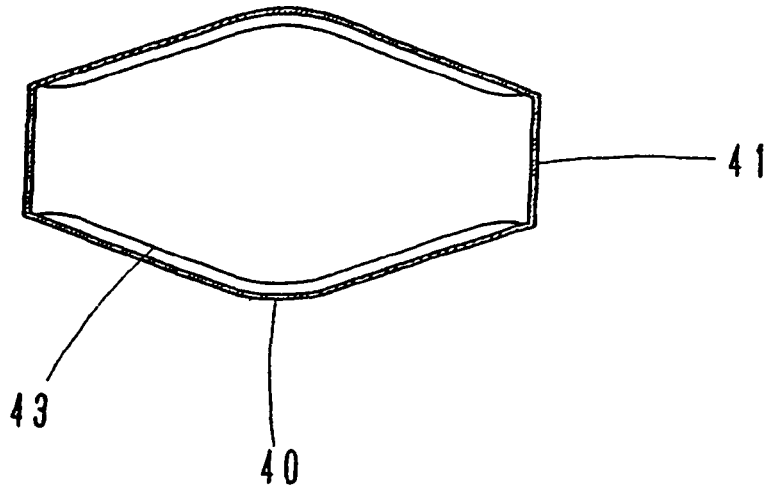
FIG. 13 is schematic transversal cross sectional views of alternative bodies of the embodiment of FIG. 10, of which (a) shows a substantially hexagonal flat cross section and (b) shows a substantially octagonal flat cross section.
Figure 13:
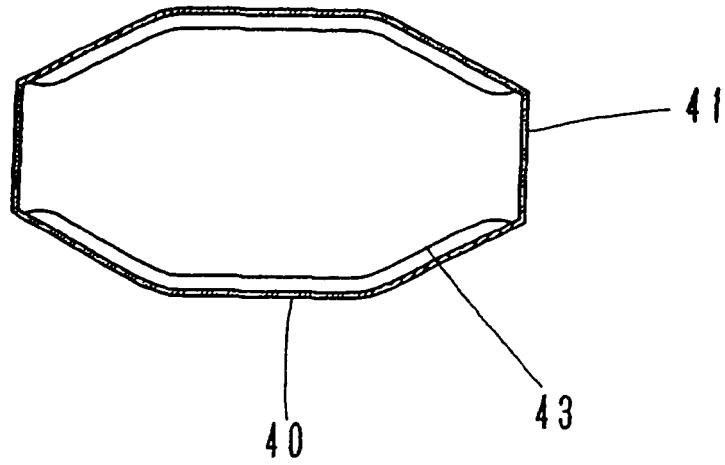

While the above described third embodiment has a body that shows a substantially elliptic flat cross section, the body may alternatively show a hexagonal or octagonal flat cross section as illustrated in FIG. 13.

Now, embodiments obtained by modifying the bottom of the above described embodiment will be described below.

As for the upper and lower transversal ribs and the longitudinal ribs arranged at the peripheral wall of the bottom, while reinforcing ribs having a rectangular recess as shown in FIG. 1 are used as longitudinal ribs 23 for the above described embodiment, the longitudinal ribs may alternatively be realized in the form of corrugation including successive recesses or in the form of elliptic recesses (not shown). Therefore, the reinforcing ribs are by no means limited to rectangular recesses.

While the reinforcing ribs of the peripheral walls section of the bottom are a combination of an upper transversal rib, a lower transversal rib and longitudinal ribs arranged between the upper and lower transversal ribs in the above description, only one or two of the three types of ribs may be used as reinforcement for the purpose of the invention.

$4^{th}$ Embodiment

Figure 14:
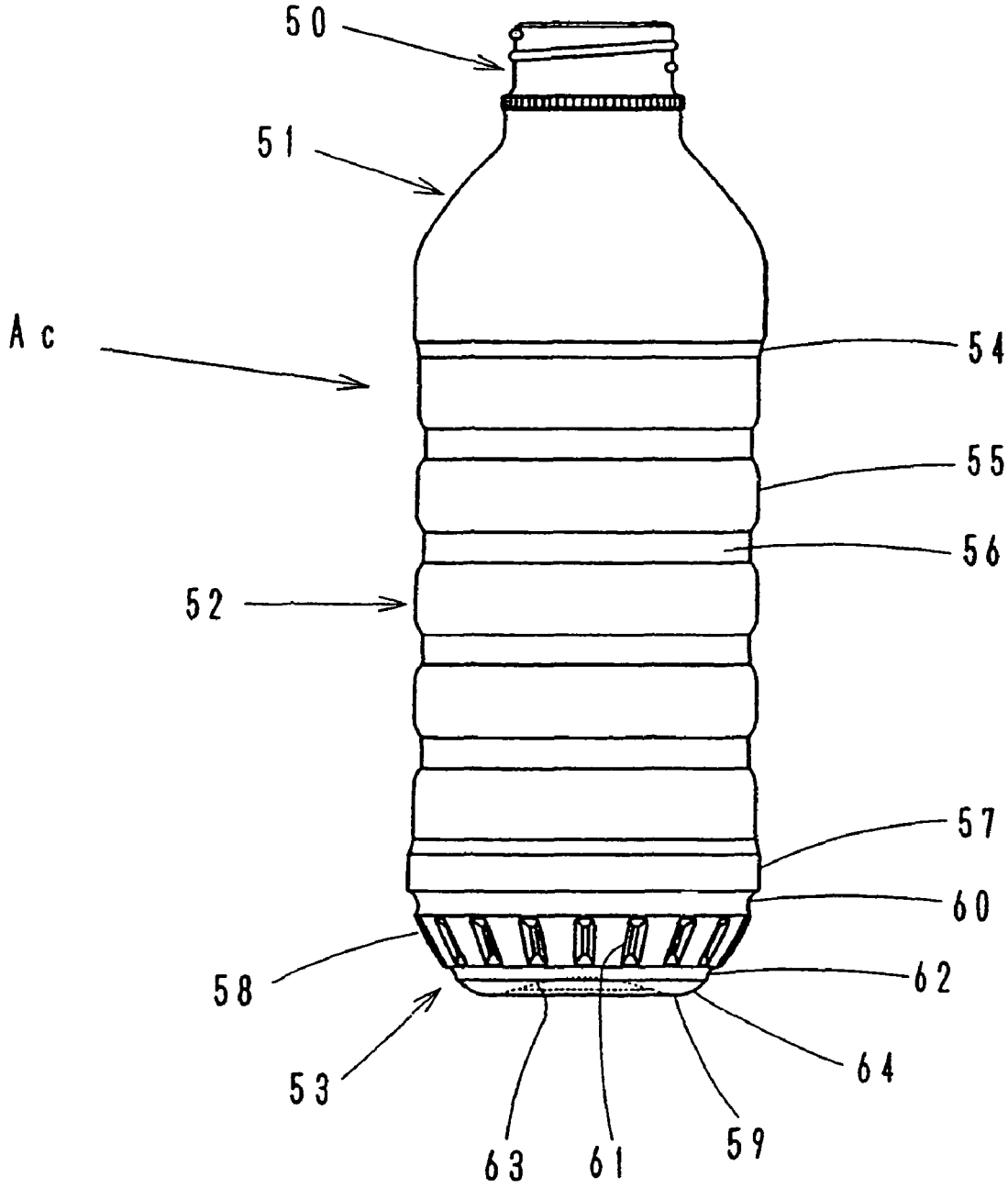
FIG. 14 is a schematic front view of a fourth embodiment of blow molded container according to the invention and showing specific features at the bottom of the container.
Figure 15:
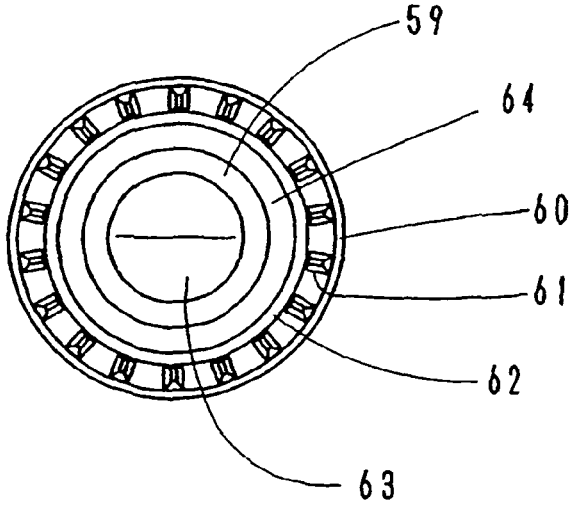
FIG. 15 is a schematic bottom view of the embodiment of FIG. 14.

This embodiment is realized by applying the reinforcing ribs of the peripheral wall of the bottom of the above embodiment to a container having a circular cross section. Thus, this embodiment differs from the above embodiment in that the shoulder, the body and the bottom show a circular cross section. FIGS. 14 and 15 schematically illustrate this embodiment.

Referring firstly to FIG. 14, this embodiment of synthetic resin thin wall container "Ac" showing a circular cross section comprises a neck 50, a shoulder 51, a body 52 and a bottom 53.

Since the neck 50 has a configuration same as its counterpart of the above embodiment, it will not be described any further here.

Both the should 51 and the body 52 show a circular cross section and a step 54 is formed between the shoulder 51 and the body 52, while transversally extending recessed grooves 56 are arranged at regular intervals on the peripheral wall 55 of the body so that the peripheral wall 55 is vertically corrugated.

The body 52 is provided at the lower end thereof with a projecting peripheral wall 57 that defines a step with the remaining upper portion of the body and is linked to the bottom 53.

As shown in FIGS. 14 and 15, the bottom 53 has a peripheral wall 58 and a bottom wall 59, of which the peripheral wall 58 is inclined by a predetermined angle relative to the bottom wall 59.

An upper transversal rib 60 is arranged to surround the container and operate as connecting section linking the peripheral wall 58 and the projecting peripheral wall 57 of the body 52. A plurality of longitudinal ribs 61 are arranged at regular intervals on the entire surface of the peripheral wall 58 of the bottom.

A lower transversal rib 62 is arranged at the lower end of the peripheral wall 58 to surround the container and linked at the lower end thereof to the bottom wall 59 of the bottom that shows an upwardly curved surface 63 at the center thereof.

As shown in FIG. 15, the outer periphery of the bottom wall 59 has a diameter remarkably smaller than that of the peripheral wall 55 of the body. Thus, the peripheral wall 58 of the bottom is inclined as its upper end is linked to the peripheral wall 55 of the body, while its lower end is linked to the outer periphery of the bottom wall 59 of the bottom.

Now, the advantages of the above described configuration of the bottom will be discussed below.

Since the lower end 64 of the peripheral wall 58 of the bottom has a diameter remarkably smaller than that of the peripheral wall 55 of the body, it shows a low blow ratio and hence has a wall thickness much greater than that of the peripheral wall 55 of the body. Thus, the peripheral wall 58 of the bottom is strong and shows an enhanced strength if subjected to impact when the container is dropped.

Additionally, since the peripheral wall 58 of the bottom is reinforced by the reinforcing ribs (60, 61, 62), it is prevented from being deformed to give rise to cracks if it is subjected to impact when the container is dropped. It also shows an improved buckling strength.

Now, a modified embodiment realized by using a zigzag rib as reinforcing ribs for the peripheral wall of the bottom will be discussed below by referring to FIG. 16.

Figure 16:
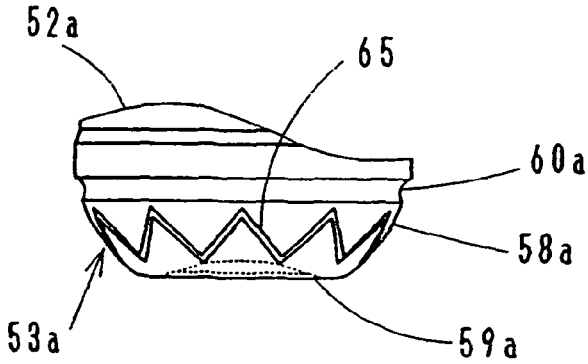
FIG. 16 is a schematic illustrations of alternative reinforcing ribs, of which (a) is a schematic front view of the bottom and (b) is a schematic bottom view.
Figure 16:
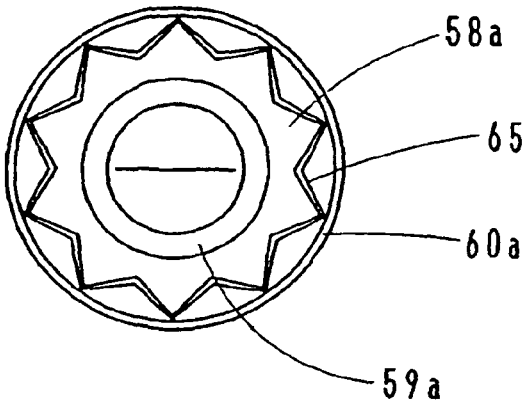
Figure 17:
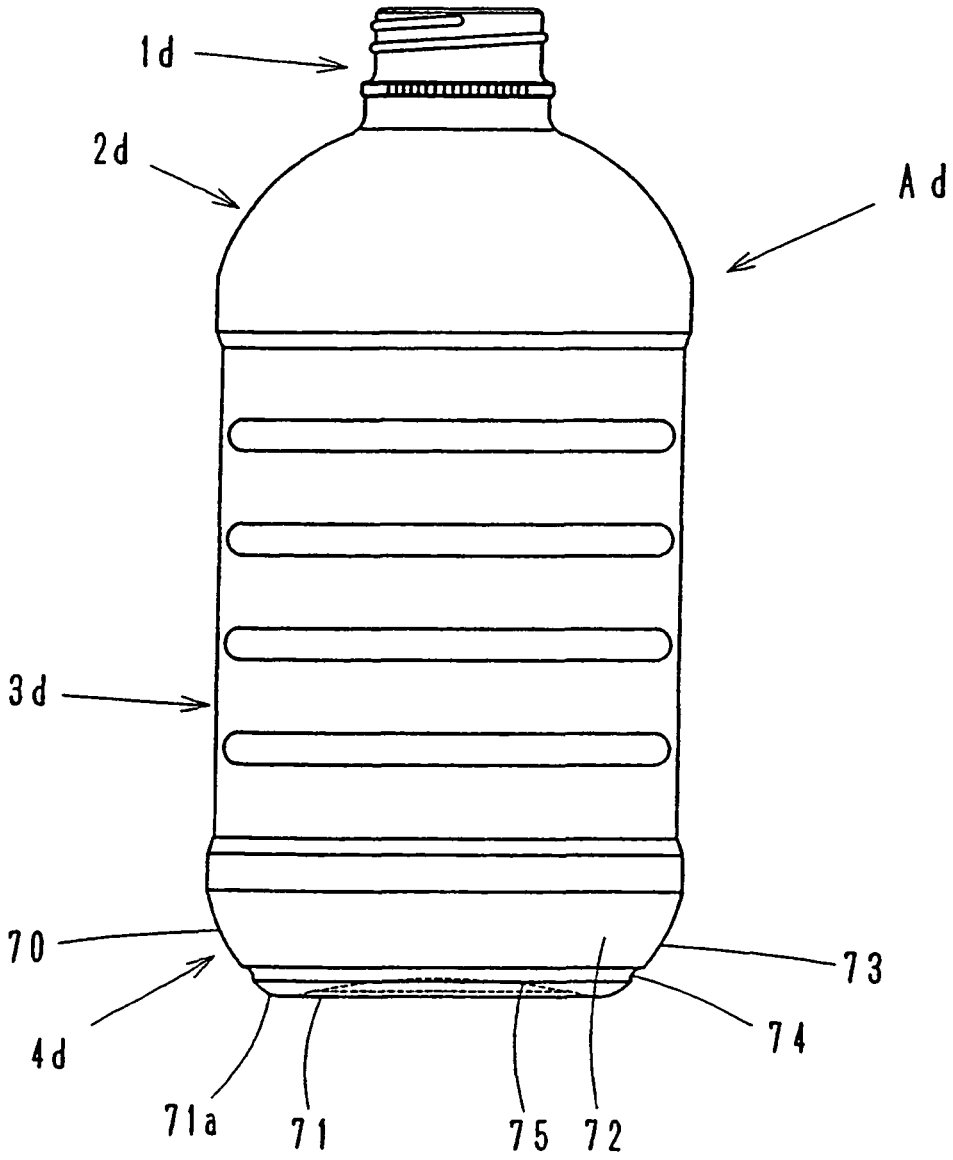
FIG. 17 is a schematic front view of a fifth embodiment of blow molded container according to the invention.
Figure 18:
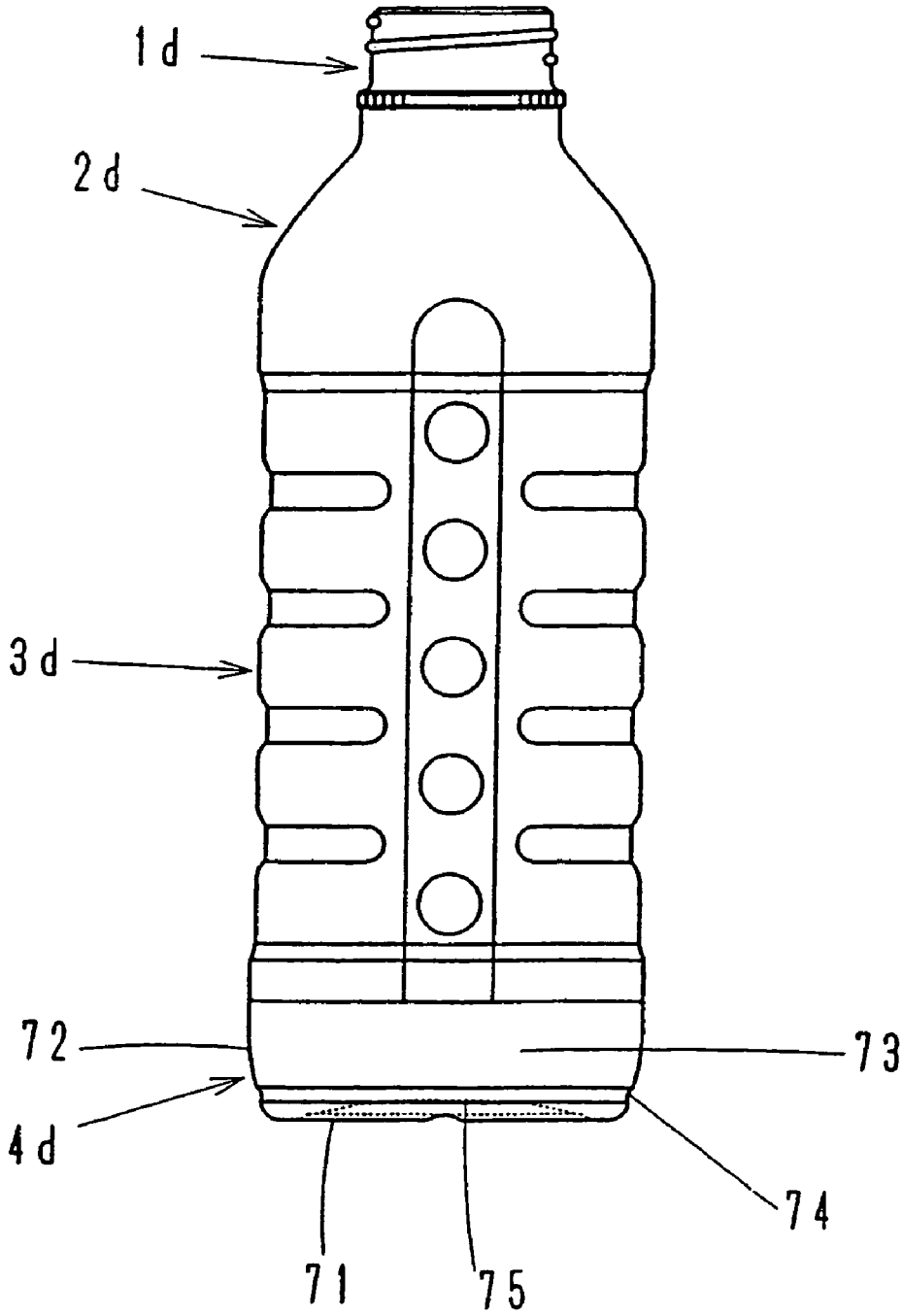
FIG. 18 is a schematic lateral view of the embodiment of FIG. 17.
Figure 19:
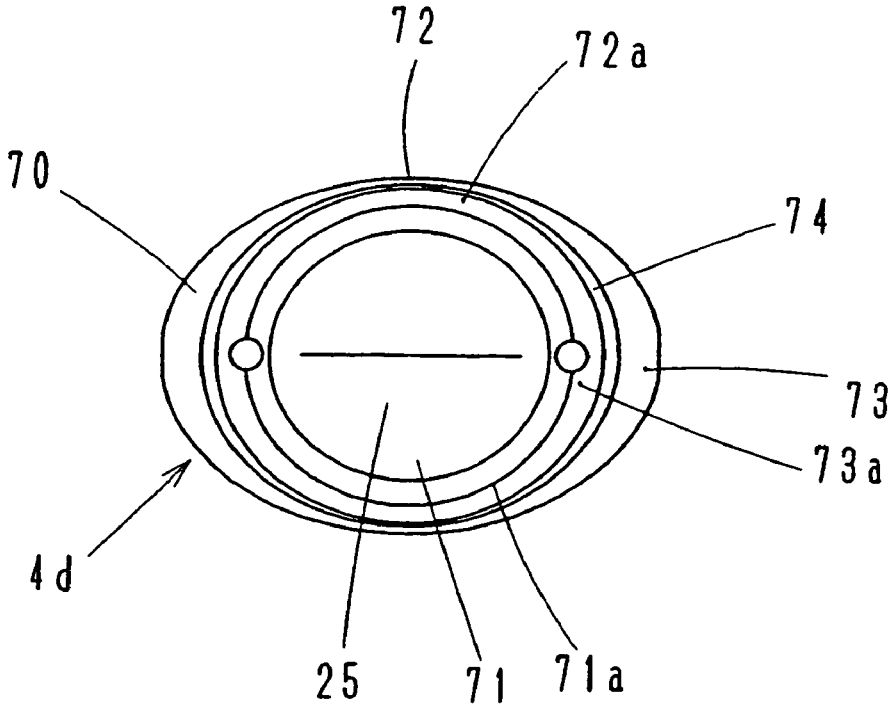
FIG. 19 is a schematic bottom view of the embodiment of FIG. 17.
Figure 20:
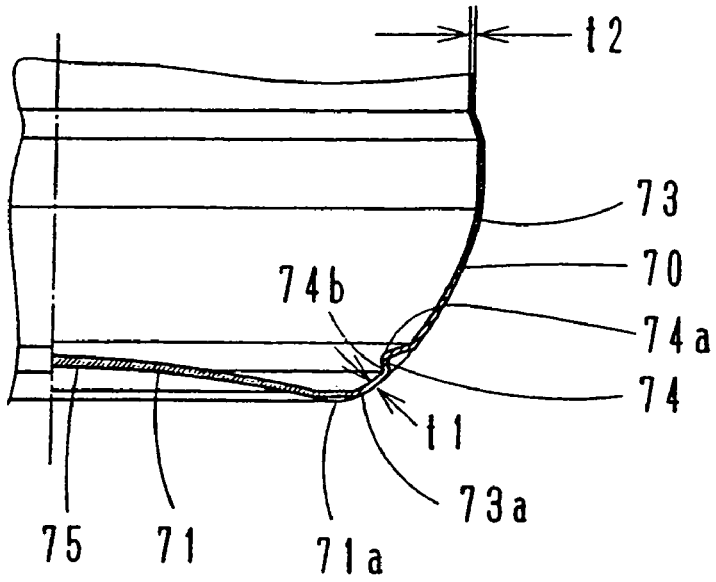
FIG. 20 is schematic illustrations of the transversal ribs of the embodiment of FIG. 17, of which (a) is a schematic cross sectional partial front view and (b) is a schematic cross sectional partial lateral view.
Figure 20:
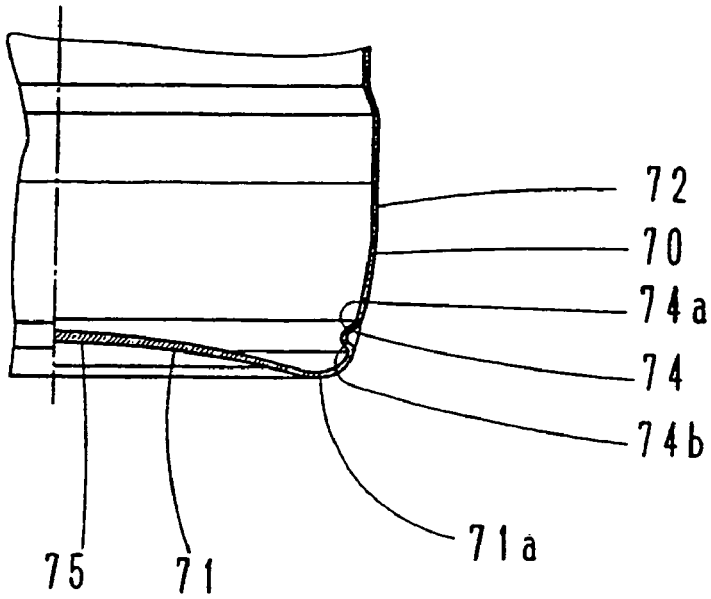

In FIG. 16, there are shown a body 52*a* and a bottom 53*a* which includes a peripheral wall 58*a* and a bottom wall 59*a*.

An upper transversal rib 60*a* is arranged as connecting section connecting the body 52*a* and the peripheral wall 58*a* of the bottom, which peripheral walls section 58*a* is linked at the lower end thereof to the bottom wall 59*a* of the bottom.

The peripheral wall 58*a* is provided on the surface thereof a zigzag rib 65 realized by arranging projecting parts and recessed parts in order to improve the vertical and peripheral strength of the bottom.

While the above described fourth embodiment is provided on the wall of the body with transversally extending recesses to make the wall of the body a corrugated one, the recesses may be replaced by zigzag ribs or the wall of the body may be made flat and straight and provided with appropriate reinforcing ribs.

$5^{th}$ Embodiment

This is an embodiment whose bottom is provided with a specifically configured rib. This embodiment will be described by referring to FIGS. 17 through 20.

Since, the neck, the shoulder and the body of this embodiment are identical with their counterparts of the above described embodiment, they are denoted respectively by the same reference numerals as those of FIGS. 1 and 2 that are accompanied by suffix d as shown in FIGS. 17 through 29 and will not be described any further. Thus, only the bottom of the embodiment will be discussed below.

Referring to FIGS. 17 through 20, the bottom 4*d* includes a peripheral wall 70 and a bottom wall 71, of which the peripheral wall 70 has slightly inclined front and rear walls 72 and a pair of side walls 73 that are inclined by a predetermined angle.

A transversal rib 74 is arranged at the lower end of the peripheral wall 70 to entirely surround the container and the lower end of the transversal rib 74 is connected to grounding bottom edge wall 71*a* of the bottom wall 71 having an upwardly curved surface 75 at the center thereof.

The transversal rib 74 is formed by an upper wall section 74*a* and a lower wall section 74*b*. Both the zone connecting the upper wall section 74*a* and the lower wall section 74*b* of the transversal rib 74 and the zone connecting the transversal rib 74 and the peripheral wall 70 of the bottom show an arcuate profile.

In connection with the angle of inclination of the side walls 73, the lower wall section 74*b* is substantially vertical while the upper wall section 74*a* is slightly inclined.

Now, the advantages of the bottom having the above described configuration will be discussed below.

Since the peripheral wall 70 has slightly inclined front and rear walls 72 and a pair of side walls 73 that are inclined by a predetermined angle, the wall thickness t1 of the lower end 73*a* of the side walls 73 is made greater than that wall thickness t2 of the side walls of the body.

As a result, the peripheral wall 70 of the bottom is improved in terms of the strength of withstanding the impact to which the bottom is subjected when the container is dropped.

Additionally, the lower wall section 74*b* of the transversal rib 74 is substantially vertical in the areas connected to the side walls 73. Thus, the buckling strength of the peripheral wall 70 of the bottom is remarkable improved due to this fact and the fact that wall thickness of the transversal rib 74 is increased at and near the grounding bottom edge wall 71*a* of the bottom wall 71.

In an experiment, a specimen of the embodiment is compared with a specimen whose peripheral wall 70 of the bottom is not provided with a rib to find that the buckling strength of the former was raised by about 25% from that of the latter.

Figure 21:
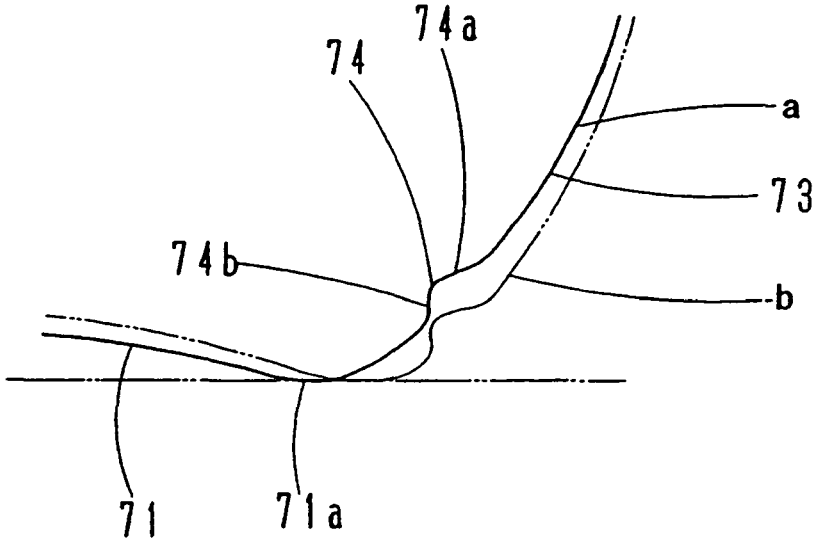
FIG. 21 is a schematic partial view of the bottom of the embodiment of FIG. 17 when it is deformed.

When the weight of the resin of a container is reduced and the bottom of the container is made to have a small wall thickness, the peripheral wall 70 and the bottom wall 71 of the bottom can become deformed from the state indicated by a in FIG. 21 to the state indicated by b in FIG. 21 as the load applied to the container is increased.

Then, with this embodiment, the lower wall section 74*b* of the transversal rib 74 pushes down the lower end of the peripheral wall 70 to outwardly shift the grounding line of the bottom and arcuately deform the bottom wall 71 so as to slightly raise the central area thereof. However, the bottom shows an improved bucking strength because the lower wall section 74*b* is made to be substantially vertical.

Thus, as this embodiment is reinforced at the body and the bottom, it can stably maintain its profile. Additionally, as the buckling strength of the bottom of this embodiment is remarkably improved by the transversal rib 74, it can reliably maintain its standing position.

$6^{th}$ Embodiment

This embodiment differs from the above described fifth embodiment only in that this embodiment has a circular cross section. This embodiment will be described by referring to FIGS. 22 and 23.

Figure 22:
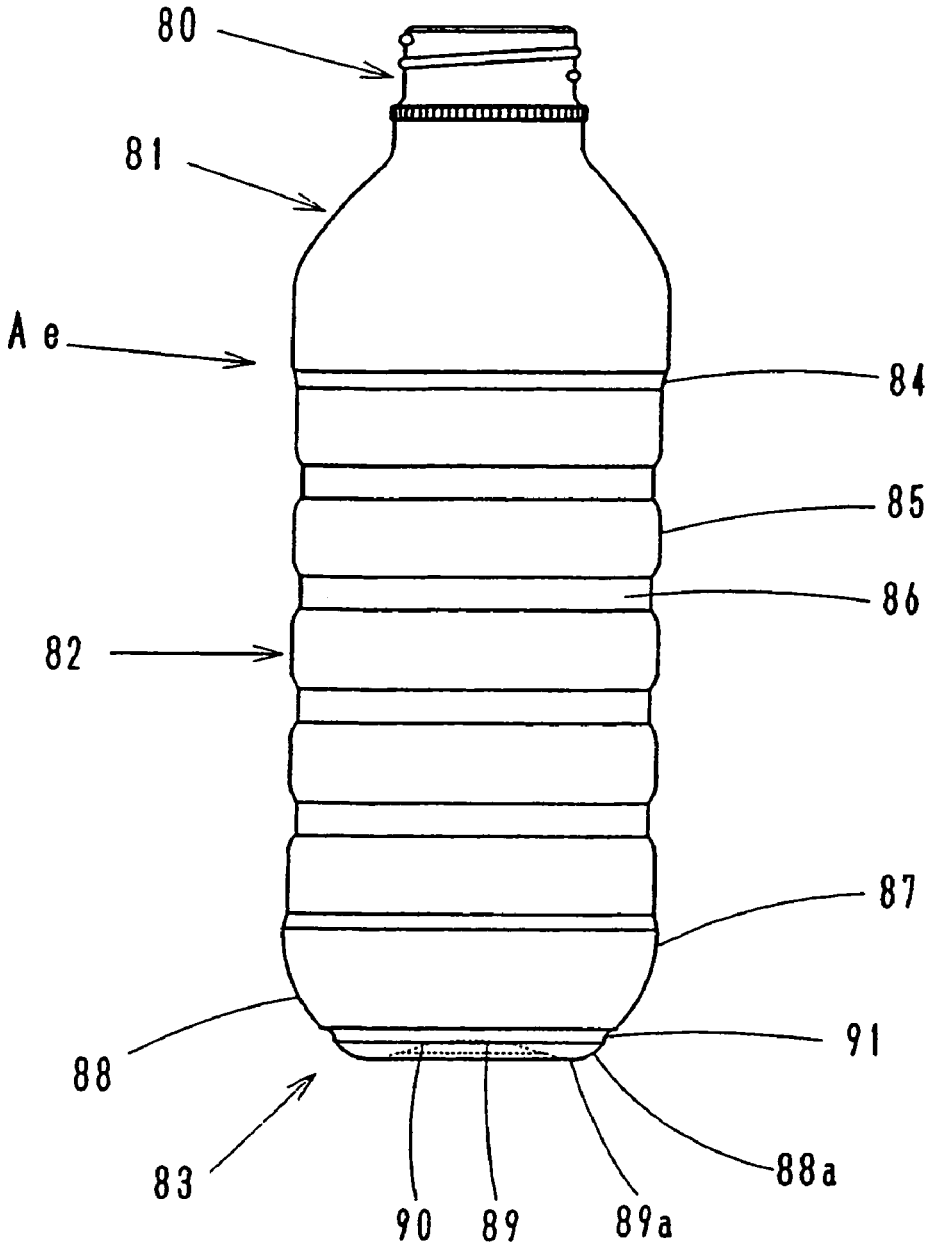
FIG. 22 is a schematic front view of a sixth embodiment of blow molded container according to the invention and showing specific features at the bottom of the container.

Referring to FIG. 22, the blow-molded thin wall container "Ae" having a circular cross section comprises a neck 80, a shoulder 81, a body 82 and a bottom 83.

Both the shoulder 81 and the body 82 show a circuit cross section and a step 84 is formed between the shoulder 81 and the body 82, while the peripheral wall 85 of the body 82 is provided with transversal recesses 86 that are arranged at regular intervals so that the peripheral wall 85 of the body is corrugated by the recesses 86.

An outwardly projecting peripheral wall 87 is formed at the lower end of the body 82 to produce a step with the remaining part of the body 82 and linked to the bottom 83.

Figure 23:
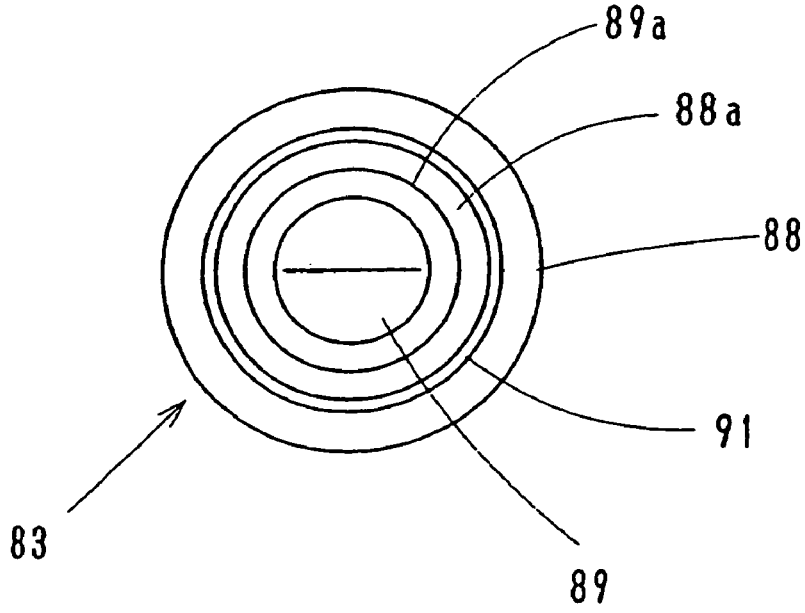
FIG. 23 is a schematic bottom view of the embodiment of FIG. 22.

As shown in FIGS. 22 and 23, the bottom 83 includes a peripheral wall 88 and a bottom wall 89, of which the peripheral wall 88 is inclined by a predetermined angle and has it slower end 88*a* linked to grounding bottom edge wall 89*a* of the bottom wall 89 having an upwardly curved surface 89 at the center thereof.

The outer periphery of the grounding bottom edge wall 89*a* of the bottom wall 89 has a diameter remarkably smaller that that of the peripheral wall 85 of the body and the lower end 88*a* of the peripheral wall 88 is so inclined as to be connected to the outer periphery of the grounding bottom edge wall 89*a* of the bottom wall 89.

A transversal rib 91 is arranged under the peripheral wall 88 of the bottom to surround the entire periphery of the container.

Figure 24:
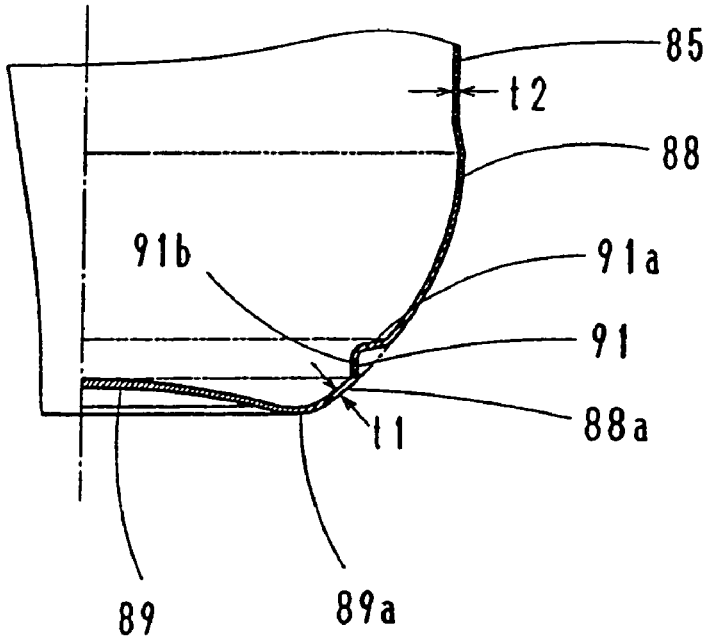
FIG. 24 is a schematic cross sectional partial view of the bottom of the embodiment of FIG. 22.

As seen from FIG. 24 that shows the bottom of the embodiment in cross section, the transversal rib 91 is formed by a pair of wall sections including an upper wall section 91*a* and a lower wall section 91*b* and the peripheral wall 88 to show a triangular cross section as in the case of the fifth embodiment. The wall sections 91*a*, 91*b* of the transversal rib 91 and the Both the zone connecting the upper wall section 91*a* and the lower wall section 91*b* of the transversal rib 91 and the zone connecting the upper wall section 91*a* and the lower wall section 91*b* show an arcuate profile.

The lower walls section 91*b* of the transversal rib 91 and the peripheral wall 88 of the bottom define a predetermined angle. In connection with the angle of inclination of the peripheral wall 88, the lower wall section 91*b* of the transversal rib 91 is substantially vertical while the upper wall section 91*a* is slightly inclined.

Now, the advantages of the bottom having the above described configuration will be discussed below.

The wall thickness t1 of the lower end 88*a* of the peripheral wall 88 of the bottom is greater than the wall thickness t2 of the peripheral wall 85 of the body because the lower end 88*a* has a diameter and a blow ratio smaller than those of the peripheral wall 88 so that the peripheral wall 88 is made strong and shows an improved strength of withstanding impact it may be subjected to when the container is dropped.

Additionally, the lower wall section 91*b* of the transversal rib 91 is substantially vertical and therefore the buckling strength of the bottom is remarkable improved due to this fact and the fact that wall thickness of the transversal rib 91 is increased at and near the grounding bottom edge wall 89*a* of the bottom wall 89.

7th Embodiment

This embodiment is realized by modifying the rib of the peripheral wall of the bottom of the fifth embodiment. This will be described by referring to FIGS. 25 through 27.

This embodiment differs from the fifth embodiment in that the transversal rib is replaced by recesses formed at regular intervals in a lower end portion of each of the side walls of the peripheral wall of the bottom that corresponds to the transversal rib.

Figure 25:
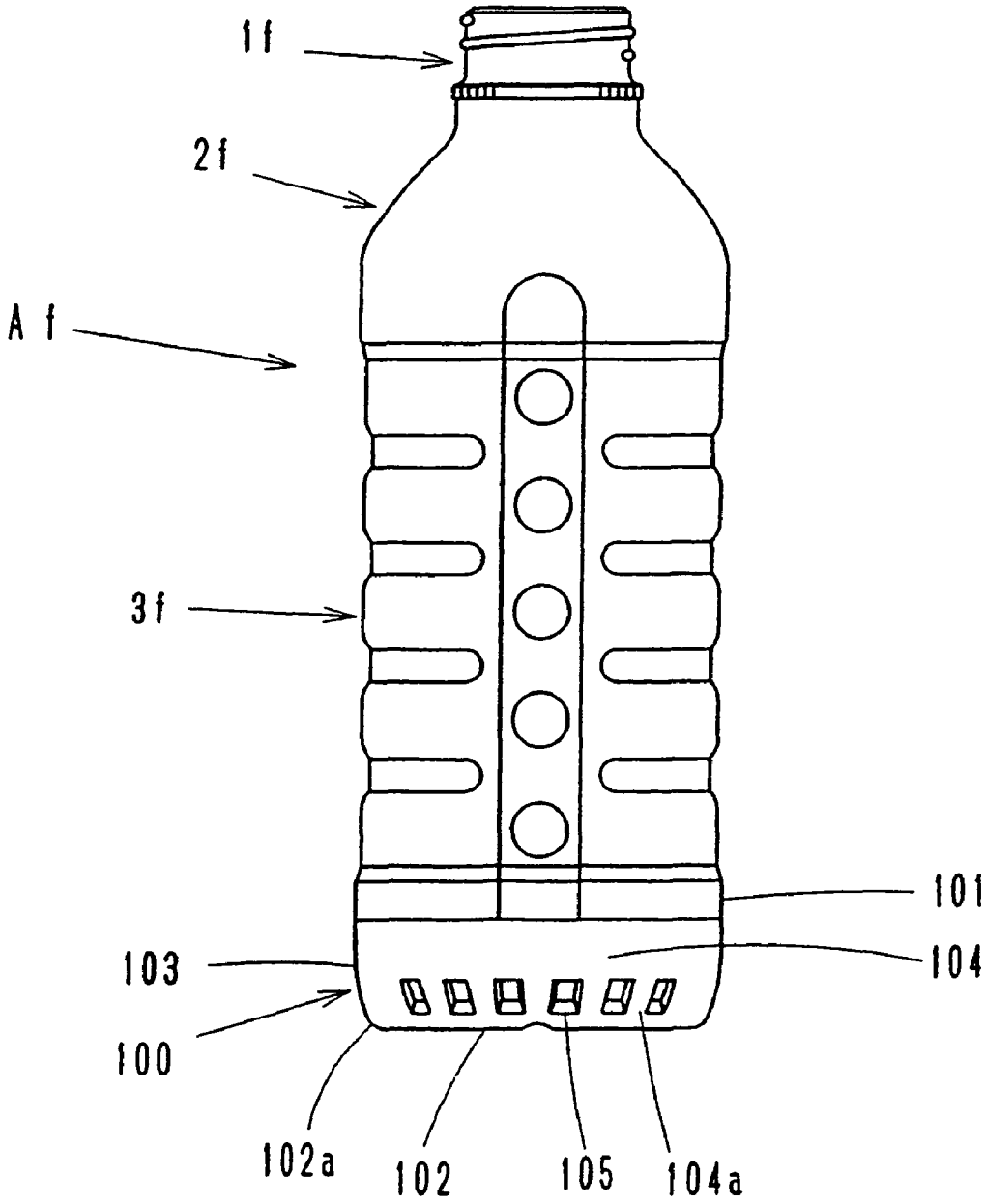
FIG. 25 is a schematic lateral view of a seventh embodiment of blow molded container according to the invention and showing specific features at the bottom of the container.

Since, the neck 1, the shoulder 2 and the body 3 of this embodiment "Af" of blow-molded thin wall flat container are identical with their counterparts of the above described sixth embodiment, they are denoted respectively by the same reference numerals that are accompanied by suffix f as shown in FIG. 25. Thus, only the bottom 100 of the embodiment will be discussed below.

Referring to FIGS. 25 through 27, 100 denotes the bottom of the flat container that includes a peripheral wall 101 and a bottom wall 102.

The peripheral wall 101 by turn includes front and rear walls 103 and side walls 104, of which the side walls 104 are inclined by a predetermined angle as in the case of the fifth embodiment and provided at the lower ends 104 thereof with recesses 105 that are arranged at regular intervals and arranged near the grounding bottom edge wall 102*a*.

Figure 26:
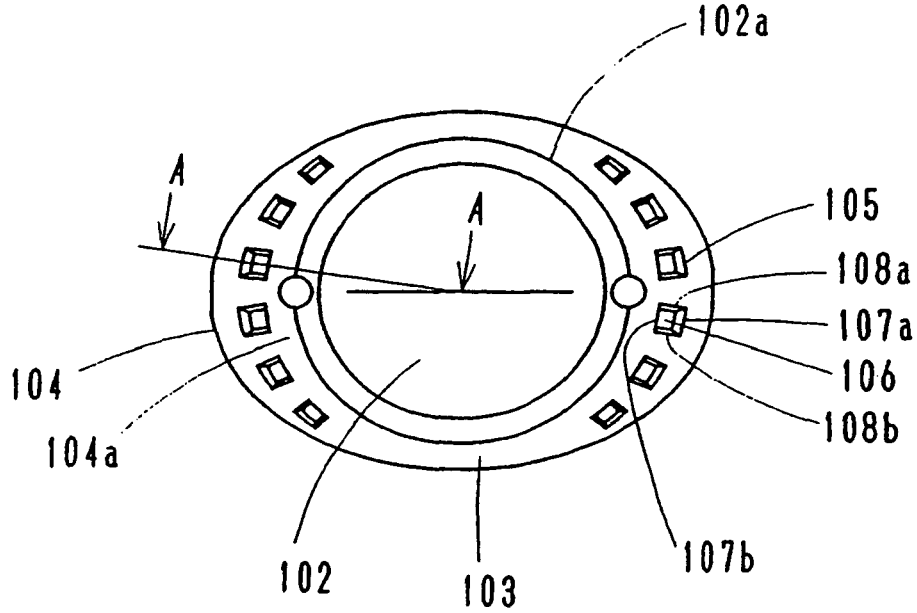
FIG. 26 is a schematic bottom view of the embodiment of FIG. 25.
Figure 27:
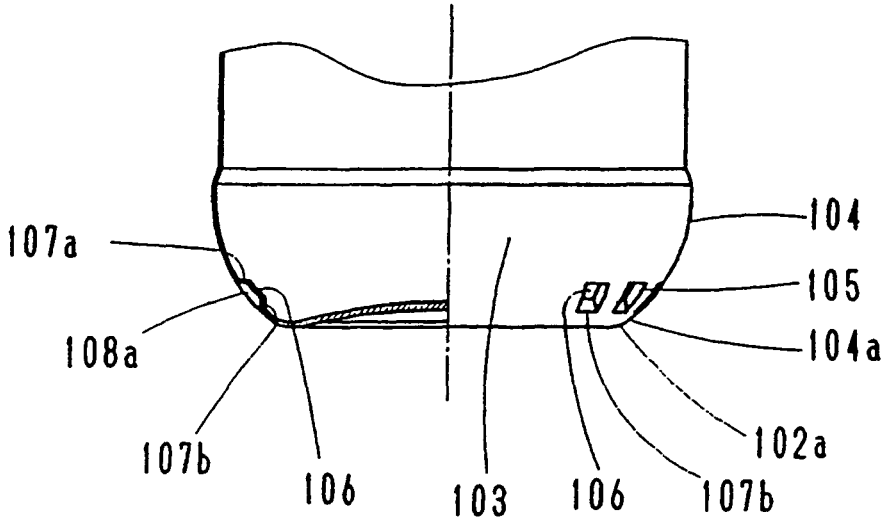
FIG. 27 is a schematic partly cross sectional front view of the bottom of the embodiment of FIG. 25 taken along line A-A in FIG. 26.

As shown in FIGS. 26 and 27, each of the recesses 105 has a rectangular flat bottom wall 106 and upper and lower connecting walls 107*a*, 107*b* linking the flat bottom wall 106 and the peripheral wall 101 of the bottom, of which the lower connecting wall 107*b* is located close to the grounding bottom edge wall 102*a* at the lower end of the peripheral wall 101 and made to stand substantially vertically so that the recesses 105 remarkably improve the buckling strength of the bottom like the transversal rib of the fifth embodiment.

8th Embodiment

This embodiment is realized by applying the recesses of the seventh embodiment to a container having a circular cross section.

In other words, as in the seventh embodiment, recesses are arranged in a lower end portion of the peripheral wall of the bottom of a blow-molded thin wall container showing a circular cross section. This will be described by referring to FIGS. 28 through 30.

Figure 28:
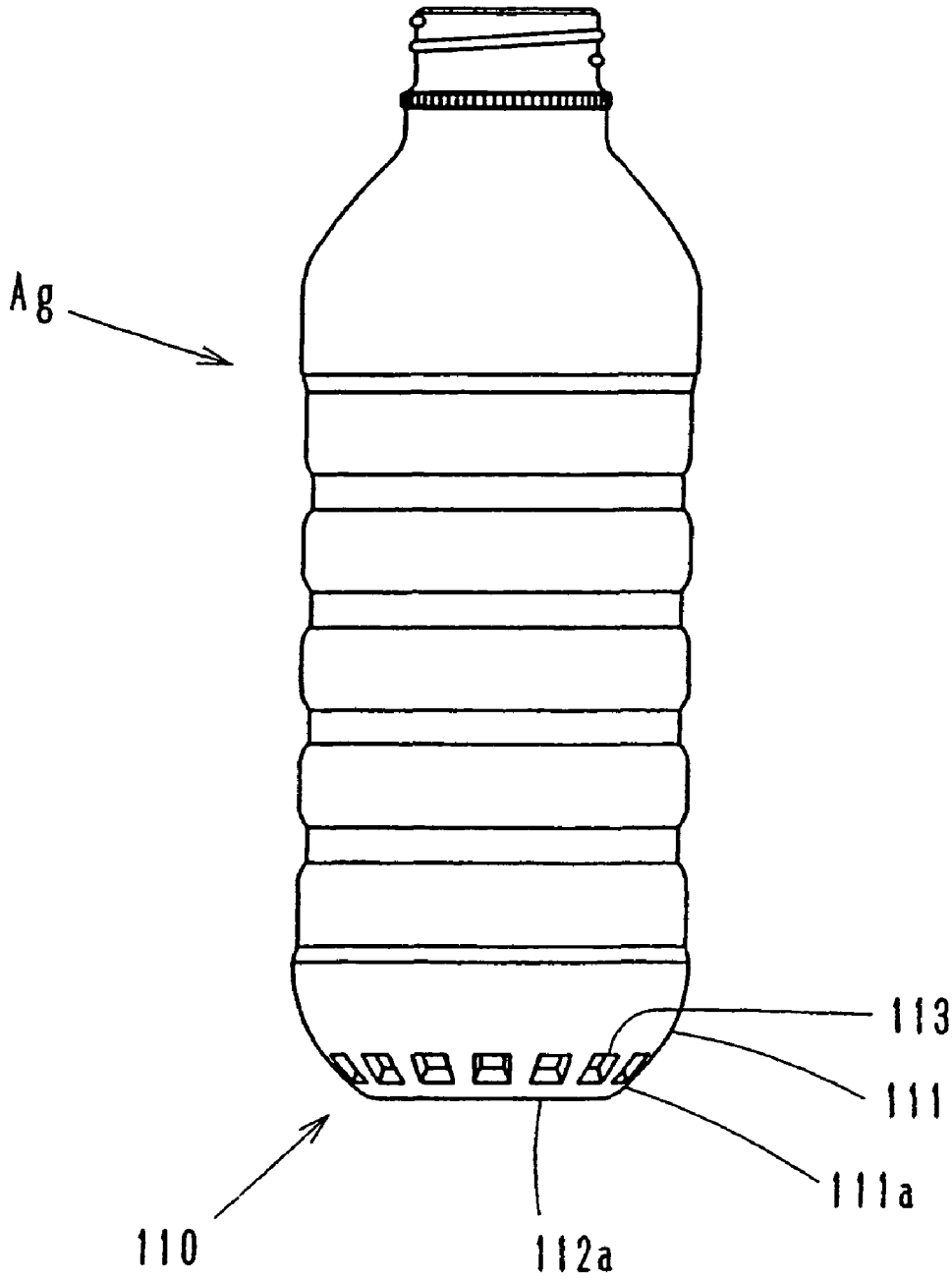
FIG. 28 is a schematic front view of an eighth embodiment of blow molded container according to the invention and showing specific features at the bottom of the container.
Figure 29:
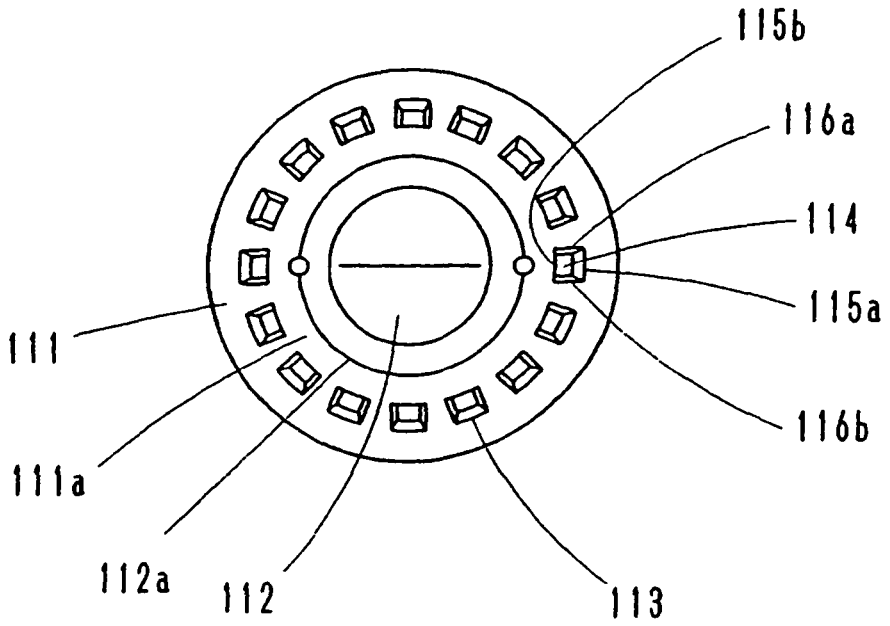
FIG. 29 is a schematic bottom view of the embodiment of FIG. 28.
Figure 30:
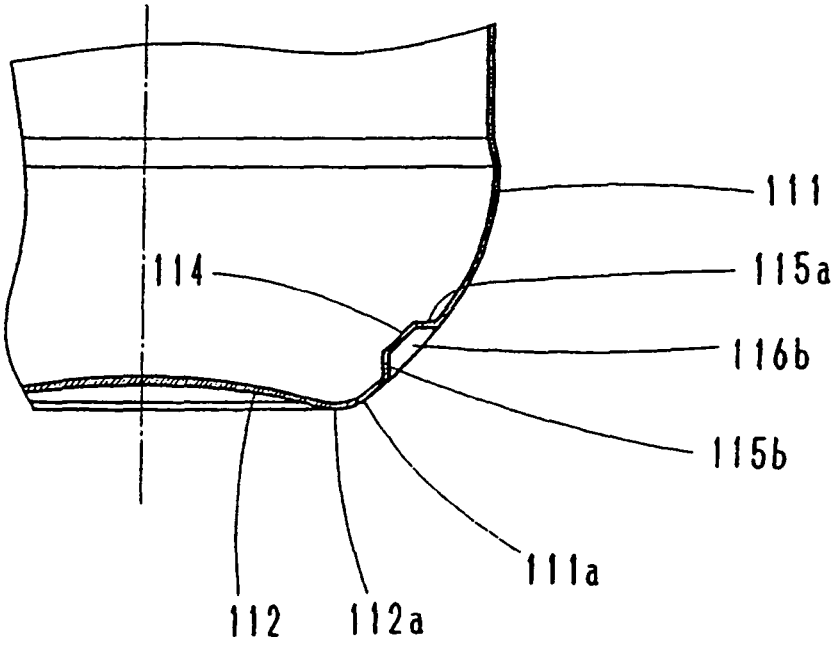
FIG. 30 is a schematic partial cross sectional view of the bottom of the embodiment of FIG. 28.

As shown in FIGS. 28 through 30, the bottom of the blow-molded thin wall container showing a circular cross section includes a peripheral wall 111 and a bottom wall 112, of which the peripheral wall 111 is inclined by a predetermined angle and has its lower end portion 111*a* linked to grounding bottom edge wall 112*a* of the bottom wall 112 having an upwardly curved surface 75 at the center thereof.

The outer periphery of the grounding bottom edge wall 112*a* of the bottom wall 59 has a diameter remarkably smaller than that of the peripheral wall 55 of the body and the upper end of the peripheral wall 111 is connected to the peripheral wall of the body while the lower end of the peripheral wall 111 is so inclined as to be connected to the outer periphery of the grounding bottom edge wall 112*a* of the bottom wall 112.

The lower end portion 111*a* of the peripheral wall 111 is provided with recesses 113 that are arranged at regular intervals near the grounding bottom edge wall 112*a*.

Each of the recesses 113 has a rectangular flat bottom wall 114, upper and lower connecting walls 115*a*, 115*b* linking the flat bottom wall 114 and the peripheral wall 111 of the bottom and lateral connecting walls 116*a*, 116*b*, of which the lower connecting wall 115*b* is located close to the grounding bottom edge wall 112*a* at the lower end 111*a* of the peripheral wall 111 and made to stand substantially vertically so that the recesses 113 remarkably improve the buckling strength of the bottom like the transversal rib of the fifth embodiment and that of the sixth embodiment.

While the recesses are rectangular in profile in the seventh and eighth embodiments, they may alternatively have an elliptic or square profile.

9th Embodiment

This embodiment is realized by modifying the neck of the above described embodiment. This will be described by referring to FIGS. 31 and 32.

Figure 31:
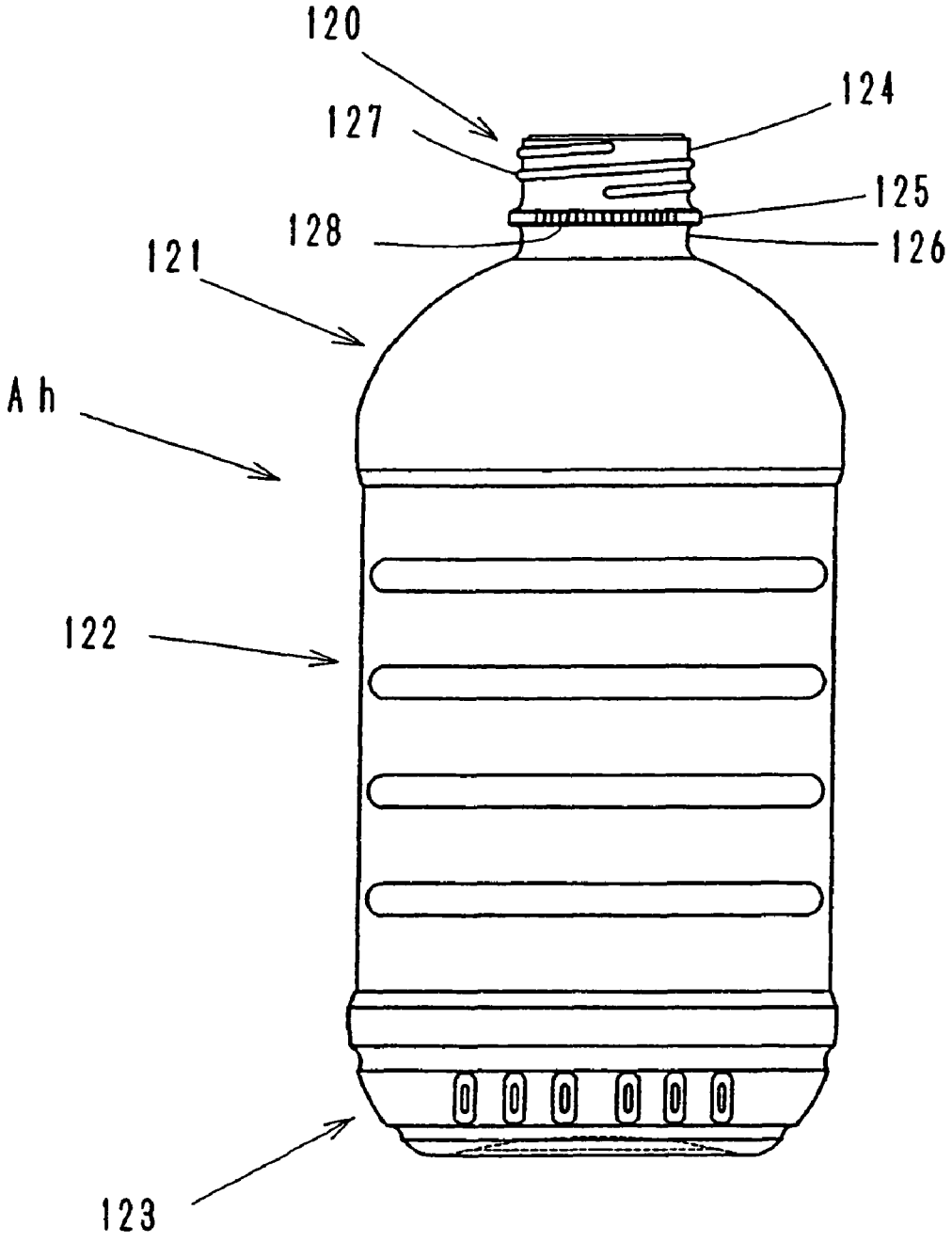
FIG. 31 is a schematic front view of a ninth embodiment of blow molded container according to the invention and showing specific features at the neck of the container.
Figure 32:
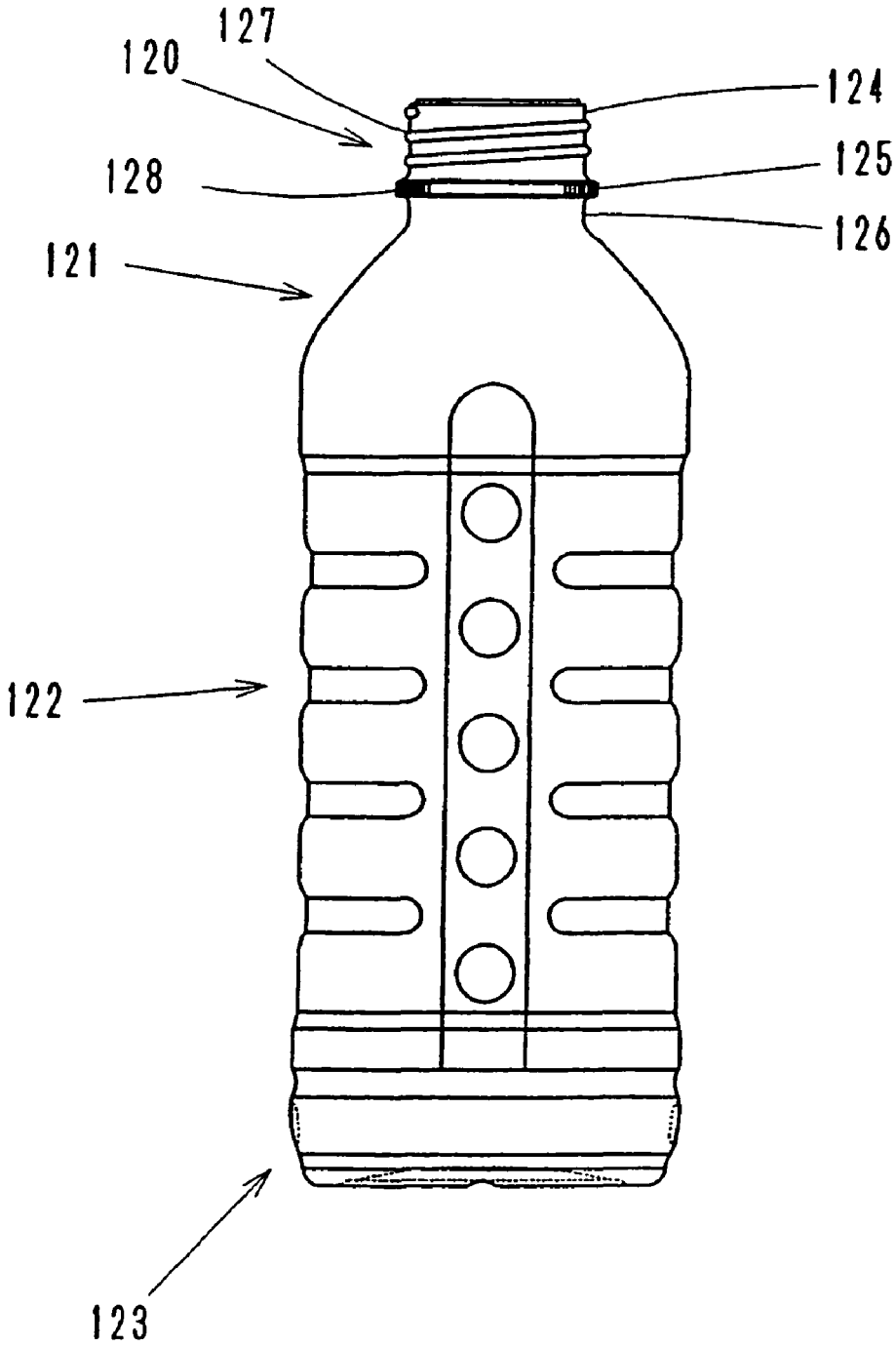
FIG. 32 is a schematic lateral view of the embodiment of FIG. 31.

As shown in FIGS. 31 and 32, the blow-molded container (Ah) comprises a neck 120, a shoulder 121, a body 122 and a bottom 123, of which the shoulder 121, the body 122 and the bottom 123 are identical with their counterparts of the above described embodiment.

The neck 120 of this embodiment includes an upper cylindrical neck section 124, a lower cylindrical neck section 126 and a neck ring 125 arranged between the upper and lower neck sections.

The upper cylindrical neck section 124 is provided on the outer peripheral surface thereof with a thread 127 and the neck ring 125 is provided on the outer peripheral surface thereof with knurls 128 that are arranged in front and rear portions or in the entire area thereof.

The lower cylindrical neck selection 126 has a height that allows the user to hold it with a thumb and fingers and is connected to the shoulder 121.

While wall thickness of the neck 120 is greater than both that of the shoulder 121 and that of the body 122, it is smaller than that of the neck of any conventional container. Therefore, the neck ring 125 formed at the middle of the neck and provided with knurls 128 significantly reinforces the neck 120 so that the container may not wobble when it is transferred nor become twisted when the cap is screwed.

Since the lower cylindrical neck section 124 located under the neck ring 125 has a predetermined height, the user can hold the container by pinching the lower cylindrical neck section 126 arranged between the neck ring 125 and the shoulder 121 with a thumb and fingers.

Thus, the cap can be easily removed when using the container.

10th Embodiment

Figure 33:
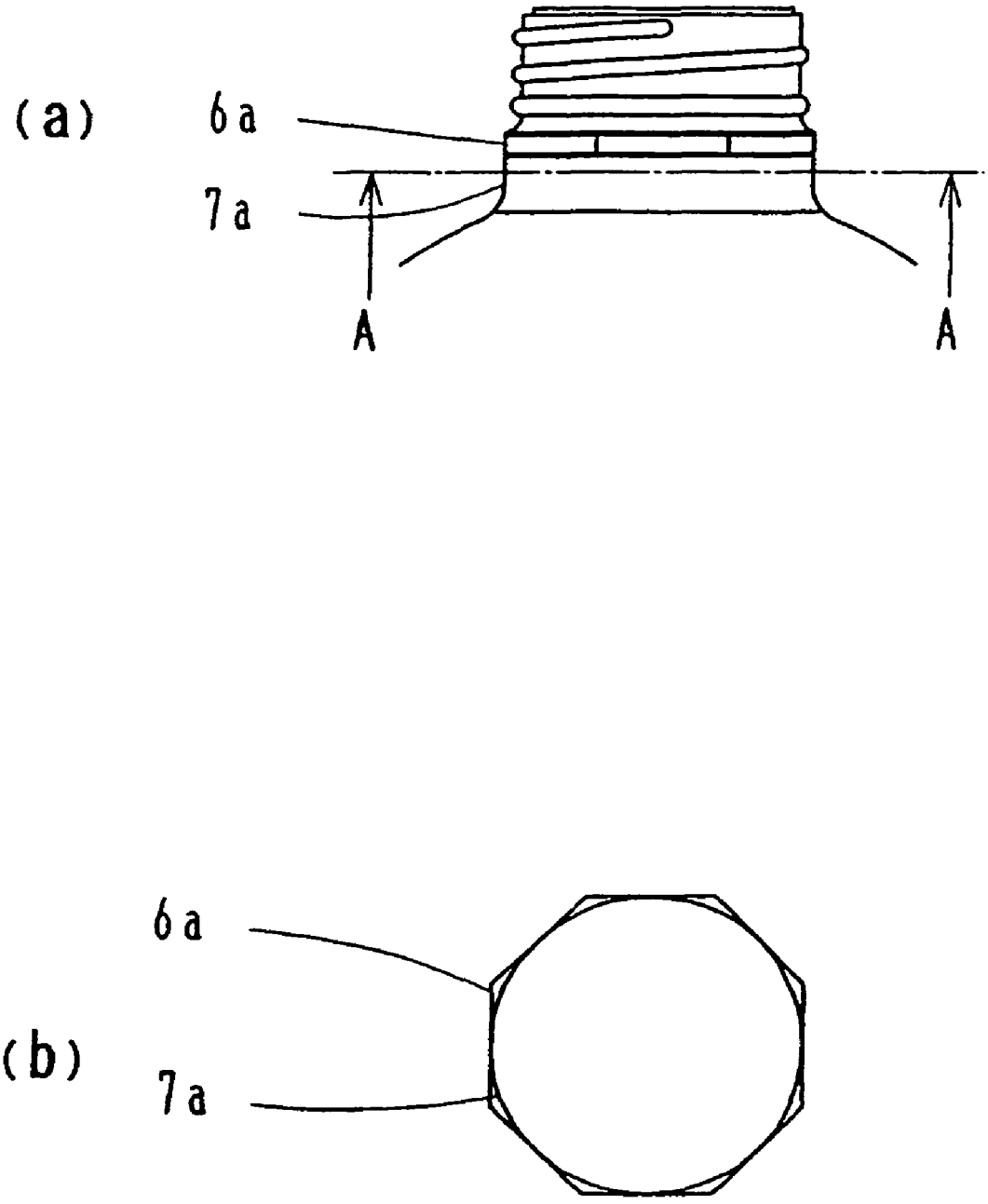
FIG. 33 is schematic illustrations of the neck of the embodiment of FIG. 32, of which (a) is a cross sectional partial front view and (b) is a schematic cross sectional view taken along line A-A in (a) and showing only the outer profile.

While the outer periphery of the holder ring 6 of the above described embodiment of container according to the invention is circular, it may alternatively be regularly hexagonal or octagonal like the holder ring 6*a* shown in FIG. 33.

Then, the outer diameter of the lower cylindrical neck section 7*a* may be reduced and the outer periphery of the lower cylindrical neck section 7*a* may be proportionally reduced relative to that of the holder ring.

As described above in detail, a synthetic resin thin wall container according to the invention can be molded by using resin at a reduced rate to save the resin material because the profile of the body and that of the bottom are improved to enhance both the rigidity and the buckling strength thereof.

Additionally, since the container has a considerably reduced wall thickness, it can be crushed with ease to reduce the volume of the waste when it is disposed.

What is claimed is:

1. A synthetic resin thin wall container having a longitudinal axis and a circular cross section, comprising a neck, a shoulder, a body and a bottom, wherein the bottom comprises a peripheral wall connected to the body, and a bottom wall, the peripheral wall is inclined by a predetermined angle and provided with reinforcing ribs, wherein each rib includes an upper connecting wall that is substantially orthogonal to the longitudinal axis of the synthetic resin thin wall container and that is disposed above a longitudinally lower connecting wall, the longitudinally lower connecting wall being disposed substantially vertical, and the longitudinally lower connecting wall is located at a lower end of the peripheral wall.

2. A synthetic resin thin wall container having a longitudinal axis and a circular cross section, comprising a neck, a body and a bottom, wherein the bottom comprises a peripheral wall connected to the body and a bottom wall, the peripheral wall is inclined by a predetermined angle, and is circumferentially provided with recesses arranged at regular intervals, and each of the recesses includes a flat intermediate wall defining a bottom of the recess and being disposed between an upper connecting wall and a longitudinally lower connecting wall, the longitudinally lower connecting wall being disposed substantially vertical and being located at a lower end of the peripheral wall.

* * * * *

UNITED STATES PATENT AND TRADEMARK OFFICE

CERTIFICATE OF CORRECTION

PATENT NO. : 7,748,553 B2
APPLICATION NO. : 10/840294
DATED : July 6, 2010
INVENTOR(S) : Yoshio Akiyama et al.

It is certified that error appears in the above-identified patent and that said Letters Patent is hereby corrected as shown below:

On the title page

Item (73) Assignee:

Please change "Yoshino Kogyosho Co., Ltd., Tochigi-shi (JP)" to "Yoshino Kogyosho Co., Ltd., Tokyo (JP)"

Signed and Sealed this
Eighteenth Day of March, 2014

Michelle K. Lee

Michelle K. Lee
*Deputy Director of the United States Patent and Trademark Office*